US011639677B1

(12) United States Patent
Scuderi

(10) Patent No.: US 11,639,677 B1
(45) Date of Patent: May 2, 2023

(54) SYSTEM AND METHODS FOR CAPTURING CARBON DIOXIDE FROM A FLOW OF EXHUAST GAS FROM A COMBUSTION PROCESS

(71) Applicant: Scuderi Group, Inc., West Springfield, MA (US)

(72) Inventor: Salvatore C. Scuderi, Westfield, MA (US)

(73) Assignee: Scuderi Group, Inc., West Springfield, MA (US)

( * ) Notice: Subject to any disclaimer, the term of this patent is extended or adjusted under 35 U.S.C. 154(b) by 0 days.

(21) Appl. No.: 17/934,279

(22) Filed: Sep. 22, 2022

(51) Int. Cl.
*F01N 3/08* (2006.01)

(52) U.S. Cl.
CPC ..... *F01N 3/0857* (2013.01); *F01N 3/0885* (2013.01); *F01N 2240/02* (2013.01); *F01N 2240/18* (2013.01); *F01N 2260/024* (2013.01); *F01N 2570/10* (2013.01)

(58) Field of Classification Search
CPC ..... F01N 2240/02; F01N 2570/10; F01N 3/0205; F01N 5/02; F01N 3/0857; F01N 3/02; F02C 6/006; F05D 2220/32; F05D 2220/30; F05D 2260/61; F02B 41/10
See application file for complete search history.

(56) References Cited

U.S. PATENT DOCUMENTS 4,899,544 A * 2/1990 Boyd ..... F01K 23/103 60/618
8,888,895 B1 11/2014 Fisher et al.
9,175,591 B2 * 11/2015 Hamad ..... F01N 3/0857
10,151,498 B2 12/2018 Moghaddam et al.
11,339,712 B1 * 5/2022 Scuderi ..... F01N 3/0205
2009/0031999 A1 2/2009 Erickson
2013/0186075 A1 * 7/2013 Myers ..... B01D 53/92 60/320
2014/0099245 A1 * 4/2014 Hamad ..... B01D 53/62 96/242
2015/0258713 A1 9/2015 Valdmaa
(Continued)

OTHER PUBLICATIONS

Kennedy, et. al., Inverted Brayton Cycle With Exhaust Gas Condensation, Journal of Engineering for Gas Turbines and Power, vol. 140 / 111702-1, Nov. 2018.
(Continued)

*Primary Examiner* — Anthony Ayala Delgado
(74) *Attorney, Agent, or Firm* — Heslin Rothenberg Farley & Mesiti P.C

(57) ABSTRACT

A carbon dioxide capture system includes a first capture tank containing carbon dioxide absorbent material which operates to absorb carbon dioxide from a flow of exhaust gas from an internal combustion engine. A heat exchange loop is in heat exchange communication with the first capture tank and further in heat exchange communication with one of the flow of exhaust gas or a flow of engine coolant from the internal combustion engine. A heat exchange fluid is operable to flow through the heat exchange loop. The heat exchange fluid operates to transfer heat from the exhaust gas or the engine coolant to the first capture tank. The heat from the exhaust gas or the engine coolant operates to release a portion of the carbon dioxide absorbed by the carbon dioxide absorbent material in the first capture tank.

29 Claims, 16 Drawing Sheets

(56) References Cited

U.S. PATENT DOCUMENTS

| | | | | |
|---|---|---|---|---|
| 2019/0120131 | A1* | 4/2019 | Scuderi | F01N 3/005 |
| 2021/0053011 | A1* | 2/2021 | Sugiyama | B01D 53/92 |

OTHER PUBLICATIONS

Precision Combustion, Inc., DOE Award No. DE-SC0017221, High-Efficiency Post Combustion Carbon Capture System, National Carbon Capture Center Test 2020.

Brunetti, et al., Membrane condenser as emerging technology for water recovery and gas pre-treatment: current status and perspectives, BMC Chemical Engineering, https://doi.org/10.1186/s42480-019-0020-x, Sep. 12, 2019 2019.

* cited by examiner

SYSTEM AND METHODS FOR CAPTURING CARBON DIOXIDE FROM A FLOW OF EXHUAST GAS FROM A COMBUSTION PROCESS

TECHNICAL FIELD

The present disclosure relates to carbon dioxide capture systems and methods of making the same. More specifically, the disclosure relates to carbon dioxide capture systems and methods used to remove carbon dioxide from a flow of exhaust gas from an internal combustion engine.

BACKGROUND

One of the most challenging aspects of today's energy technologies is to effectively capture the carbon dioxide from the exhaust gas of a combustion process of, for example, an internal combustion engine. Carbon dioxide capture systems frequently route such exhaust gas through one or more tanks containing a carbon dioxide absorbent material. The carbon dioxide absorbent material then absorbs the carbon dioxide from the exhaust gas as the exhaust gas passes through the tanks.

However, the carbon dioxide absorbent material will become saturated over time. When that occurs, the carbon dioxide absorbent material will have to be heated to regenerate the carbon dioxide and containerize it.

Problematically, the heating process to regenerate carbon dioxide is energy intensive and may result in a significant decrease in the efficiency of the internal combustion engine that the carbon dioxide capture system is servicing. The efficiency drop may be between 10% to 15% of the overall efficiency of the engine. Often time, this efficiency drop makes the engine connected to the carbon dioxide capture system uncompetitive with other engines that do not utilize a carbon dioxide capture system. As a result, there is little financial incentive for a user to retrofit an engine with a carbon dioxide capture system, unless the user is regulated to do so by law.

Accordingly, there is a need for a carbon dioxide capture system that provides a reduced burden on the efficiency of the engine it is associated with. Additionally, there is a need for a carbon dioxide capture system that would have no detrimental effect on the efficiency of an engine it is associated with.

BRIEF DESCRIPTION

The present disclosure offers advantages and alternatives over the prior art by providing a carbon dioxide capture system that utilizes the waste heat generated from an engine that the carbon dioxide capture system is servicing to regenerate the captured carbon dioxide and containerize it. The carbon dioxide capture system may utilize the waste heat from the engine's engine coolant. Alternatively, the carbon dioxide capture system may utilize the waste heat from the engine's exhaust gas that the carbon dioxide capture system is removing carbon dioxide from. Moreover, the carbon dioxide capture system may utilize a turbine-generator system to generate electric power from the waste heat of the exhaust gas to help power the carbon dioxide capture system itself.

The result of such carbon dioxide systems and methods of the present disclosure is that they present little to no burden on the efficiency of the engines they service. Additionally, such carbon dioxide capture systems may be retrofit to any electric power generator system that is powered by an internal combustion engine without effecting the competitiveness of the generator system.

A carbon dioxide capture system in accordance with one or more aspects of the present disclosure includes a first capture tank containing carbon dioxide absorbent material which operates to absorb carbon dioxide from a flow of exhaust gas from an internal combustion engine. A heat exchange loop is in heat exchange communication with the first capture tank and further in heat exchange communication with one of the flow of exhaust gas or a flow of engine coolant from the internal combustion engine. A heat exchange fluid is operable to flow through the heat exchange loop. The heat exchange fluid operates to transfer heat from the exhaust gas or the engine coolant to the first capture tank. The heat from the exhaust gas or the engine coolant operates to release a portion of the carbon dioxide absorbed by the carbon dioxide absorbent material in the first capture tank.

In some examples of the carbon dioxide capture system, there is included an exhaust gas to heat exchange fluid heat exchanger. The exhaust gas to heat exchange fluid heat exchanger includes a first flow path and a second flow path, which operate to exchange heat therebetween. The first flow path operates to receive therethrough the flow of exhaust gas from the engine. The second flow path operates to receive therethrough the flow of heat exchange fluid in the heat exchange loop. The exhaust gas to heat exchange fluid heat exchanger operates to transfer heat from the exhaust gas to the heat exchange fluid. The heat exchange loop operates to flow the heat exchange fluid to the first capture tank and to transfer heat from the heat exchange fluid to the absorbent material in the first capture tank.

In some examples of the carbon dioxide capture system, the flow of exhaust gas passes through the first capture tank prior to the flow of exhaust gas passing through the first flow path of the exhaust gas to heat exchange fluid heat exchanger.

In some examples of the carbon dioxide capture system, the flow of exhaust gas passes through the first flow path of the exhaust gas to heat exchange fluid heat exchanger prior to the flow of exhaust gas passing the first capture tank.

In some examples of the carbon dioxide capture system, there is included a turbine-generator system. The turbine generator system includes a turbo-expander and turbo-compressor disposed on a turbo-crankshaft. The turbo-expander operates to rotate the turbo-crankshaft as the flow of exhaust gas passes through the turbo-expander. The turbo-compressor operates to compress the flow of exhaust gas after the exhaust gas passes through the turbo-expander. The flow of exhaust gas is routed through the turbo-expander, then through the first flow path of the exhaust gas to heat exchange fluid heat exchanger, then through the turbo-compressor, then through the first capture tank.

In some examples of the carbon dioxide capture system, the heat exchange loop is configured to receive the exhaust gas from the engine such that the exhaust gas is the heat exchange fluid that is operable to flow through the heat exchange loop.

In some examples of the carbon dioxide capture system, the flow of exhaust gas passes through the first capture tank prior to the exhaust gas passing through the heat exchange loop.

In some examples of the carbon dioxide capture system, the flow of exhaust gas passes through the heat exchange loop prior to the exhaust gas passing through the first capture tank.

In some examples of the carbon dioxide capture system, there is included an engine coolant to heat exchange fluid heat exchanger. The engine coolant to heat exchange fluid heat exchanger includes a first flow path and a second flow path, which operate to exchange heat therebetween. The first flow path operates to receive therethrough the flow of engine coolant from the engine. The second flow path operates to receive therethrough the flow of heat exchange fluid in the heat exchange loop. The engine coolant to heat exchange fluid heat exchanger operates to transfer heat from the engine coolant to the heat exchange fluid. The heat exchange loop operates to flow the heat exchange fluid to the first capture tank and to transfer heat from the heat exchange fluid to the absorbent material in the first capture tank.

In some examples of the carbon dioxide capture system, the heat exchange loop is configured to receive the engine coolant from the engine such that the engine coolant is the heat exchange fluid that is operable to flow through the heat exchange loop.

In some examples of the carbon dioxide capture system, there is included a turbine-generator system. The turbine-generator system includes a turbo-expander and turbo-compressor disposed on a turbo-crankshaft. The turbo-expander operates to rotate the turbo-crankshaft as the flow of exhaust gas passes through the turbo-expander. The turbo-compressor operates to compress the flow of exhaust gas after the exhaust gas passes through the turbo-expander.

In some examples of the carbon dioxide capture system, the turbine-generator system includes a bottoming cycle generator disposed on the turbo-crankshaft. The bottoming cycle generator is connected to the carbon dioxide capture system. The bottoming cycle generator operates to provide at least a portion of electric power required to operate the carbon dioxide capture system.

In some examples of the carbon dioxide capture system, the flow of exhaust gas passes through the turbo-expander and the turbo-compressor prior to the flow of exhaust gas passing through the first capture tank.

In some examples of the carbon dioxide capture system, the flow of exhaust gas passes through the first capture tank prior to the flow of exhaust gas passing through turbo-expander and the turbo-compressor.

In some examples of the carbon dioxide capture system, an exhaust gas processing system receives and cools the flow of exhaust gas after the exhaust gas has passed through turbo-expander and prior to the exhaust gas being compressed by the turbo-compressor. The exhaust gas processing system may include at least one of a cooling tower, a cooling tower heat exchanger, an absorption chiller, an absorption chiller heat exchanger, a dehumidifier system and a vapor-compression refrigeration system.

In some examples of the carbon dioxide capture system, there is included an exhaust gas to exhaust gas heat exchanger. The exhaust gas to exhaust gas heat exchanger includes a first flow path and a second flow path which operate to exchange heat therebetween. The first flow path operates to receive the flow of exhaust gas from the turbo-expander prior to the exhaust gas being compressed by the turbo-compressor. The second flow path operates to receive the flow of exhaust gas from the turbo-compressor after the exhaust gas has been compressed by the turbo-compressor.

In some examples of the carbon dioxide capture system, the first capture tank includes an exhaust gas inlet port connected to the flow of exhaust gas prior to the exhaust gas passing through the carbon dioxide absorbent material. An exhaust gas outlet port is connected to the flow of exhaust gas after the flow of exhaust gas has passed through carbon dioxide absorbent material. A second capture tank, contains carbon dioxide absorbent material which operates to absorb carbon dioxide from the exhaust gas. The second capture tank includes an exhaust gas inlet port connected to the flow of exhaust gas prior to the exhaust gas passing through the carbon dioxide absorbent material. An exhaust gas outlet port is connected to the flow of exhaust gas after the flow of exhaust gas has passed through carbon dioxide absorbent material. The heat exchange loop is in heat exchange communication with either the first capture tank or the second capture tank. The heat exchange fluid operates to transfer heat from the exhaust gas or the engine coolant to either the first capture tank or the second capture tank. The heat from the exhaust gas or the engine coolant operates to release a portion of the carbon dioxide absorbed by the carbon dioxide absorbent material in either the first capture tank or the second capture tank.

In some examples of the carbon dioxide capture system, when the exhaust gas inlet port of the first capture tank is connected to receive the flow of exhaust gas prior to the exhaust gas passing through the carbon dioxide absorbent material in the first capture tank, then the exhaust gas outlet port of the first capture tank is connected to output the flow of exhaust gas after the exhaust gas has passed through the carbon dioxide absorbent material in the first capture tank and the heat exchange loop is in heat exchange communication with the second capture tank. The heat exchange fluid operates to transfer heat from the exhaust gas or the engine coolant to the second capture tank. The heat from the exhaust gas or the engine coolant operates to release a portion of the carbon dioxide absorbed by the carbon dioxide absorbent material in the second capture tank. When the exhaust gas inlet port of the second capture tank is connected to receive the flow of exhaust gas prior to the exhaust gas passing through the carbon dioxide absorbent material in the second capture tank, then the exhaust gas outlet port of the second capture tank is connected to output the flow of exhaust gas after the exhaust gas has passed through the carbon dioxide absorbent material in the second capture tank and the heat exchange loop is in heat exchange communication with the first capture tank. The heat exchange fluid operates to transfer heat from the exhaust gas or the engine coolant to the first capture tank. The heat from the exhaust gas or the engine coolant operates to release a portion of the carbon dioxide absorbed by the carbon dioxide absorbent material in the first capture tank.

A method of removing carbon dioxide from a flow of exhaust gas from an internal combustion engine in accordance with one or more aspects of the present disclosure incudes routing the flow of exhaust gas into a first capture tank of a carbon dioxide capture system. Carbon dioxide in the first capture tank is absorbed from the exhaust gas with carbon dioxide absorbent material disposed in the first capture tank. The flow of exhaust gas is routed out of the first capture tank. A heat exchange loop is connected in heat exchange communication with the first capture tank and further in heat exchange communication with one of the flow of exhaust gas or a flow of engine coolant from the internal combustion engine. A heat exchange fluid is circulated through the heat exchange loop. Heat from the exhaust gas or the engine coolant is transferred to the first capture tank via the heat exchange fluid. A portion of the carbon dioxide absorbed by the carbon dioxide absorbent material in the first capture tank is released, as a result of the heat transferred from the exhaust gas or the engine coolant.

In some examples of the method, the flow of exhaust gas is routed through a first flow path of an exhaust gas to heat exchange fluid heat exchanger. The heat exchange fluid is routed through a second flow path of the exhaust gas to heat exchange fluid heat exchanger. Heat is transferred from the exhaust gas to the heat exchange fluid via the exhaust gas to heat exchange fluid heat exchanger. The heat exchange fluid flows to the first capture tank. Heat is transferred from the heat exchange fluid to the absorbent material in the first capture tank.

In some examples of the method, the exhaust gas from the engine is received into the heat exchange loop, such that the exhaust gas is the heat exchange fluid that flows through the heat exchange loop.

In some examples of the method, the flow of engine coolant is routed through a first flow path of an engine coolant to heat exchange fluid heat exchanger. The heat exchange fluid is routed through a second flow path of the engine coolant to heat exchange fluid heat exchanger. Heat is transferred from the engine coolant to the heat exchange fluid via the engine coolant to heat exchange fluid heat exchanger. The heat exchange fluid flows to the first capture tank. Heat is transferred from the heat exchange fluid to the absorbent material in the first capture tank.

In some examples of the method, the engine coolant from the engine is received into the heat exchange loop, such that the exhaust gas is the heat exchange fluid that flows through the heat exchange loop.

In some examples of the method, the flow of exhaust gas is routed through a turbo-expander disposed on a turbo-crankshaft of a turbine-generator system. The flow of exhaust gas is compressed via a turbo-compressor disposed on the turbo-crankshaft of the turbine-generator system after the exhaust gas passes through the turbo-expander. Electric power is generated via a bottoming cycle generator disposed on the turbo-crankshaft of the turbine-generator system. At least a portion of electric power required to operate the carbon dioxide capture system is provided from the electric power generated by the bottoming cycle generator.

In some examples of the method, the flow of exhaust gas is routed into a second capture tank of the carbon dioxide capture system. Carbon dioxide in the second capture tank is absorbed from the exhaust gas with carbon dioxide absorbent material disposed in the second capture tank. The flow of exhaust gas is routed out of the second capture tank. The heat exchange loop is connected in heat exchange communication with either the first capture tank or the second capture tank and further in heat exchange communication with one of the flow of exhaust gas or a flow of engine coolant from the internal combustion engine. The heat exchange fluid is circulated through the heat exchange loop. Heat from the exhaust gas or the engine coolant is transferred to either the first capture tank or the second capture tank via the heat exchange fluid. A portion of the carbon dioxide absorbed by the carbon dioxide absorbent material in either the first capture tank or the second capture tank is released, as a result of the heat transferred from the exhaust gas or the engine coolant.

In some examples of the method, the heat exchange loop is connected in heat exchange communication with the second capture tank and further in heat exchange communication with one of the flow of exhaust gas or a flow of engine coolant when the flow of exhaust gas is routed into the first capture tank. The heat exchange loop is connected in heat exchange communication with the first capture tank and further in heat exchange communication with one of the flow of exhaust gas or a flow of engine coolant when the flow of exhaust gas is routed into the second capture tank.

In some examples of the method, the flow of exhaust gas is routed through a turbo-expander of a turbine-generator system, then through the first flow path of the exhaust gas to heat exchange fluid heat exchanger, then through a turbo-compressor of the turbine-generator system, then through the first capture tank.

It should be appreciated that all combinations of the foregoing concepts and additional concepts discussed in greater detail below (provided such concepts are not mutually inconsistent) are contemplated as being part of the inventive subject matter disclosed herein and may be used to achieve the benefits and advantages described herein.

DRAWINGS

The disclosure will be more fully understood from the following detailed description taken in conjunction with the accompanying drawings, in which:

FIG. 1 depicts an example of a schematic view of at least a portion of a carbon dioxide capture system having a first capture tank with carbon dioxide absorbent material disposed therein, wherein the carbon dioxide capture system is removing carbon dioxide from a flow of exhaust gas from an internal combustion engine that is passing through the first capture tank and further utilizing heat from the exhaust gas to regenerate the carbon dioxide according to aspects described herein;

FIG. 2 depicts an example of a schematic view of the carbon dioxide capture system of FIG. 1 having a first and a second capture tank, wherein the carbon dioxide capture system utilizes an exhaust gas to heat exchange fluid heat exchanger to transfer heat from the exhaust gas to a heat exchange fluid in a heat exchange loop that is in heat exchange communication with the first and second capture tanks, according to aspects described herein;

FIG. 3 depicts another example of a schematic view of the carbon dioxide capture system of FIG. 1 having a first and a second capture tank, wherein the carbon dioxide capture system utilizes an exhaust gas to heat exchange fluid heat exchanger to transfer heat from the exhaust gas to a heat exchange fluid in a heat exchange loop that is in heat exchange communication with the first and second capture tanks, according to aspects described herein;

Figure 1:
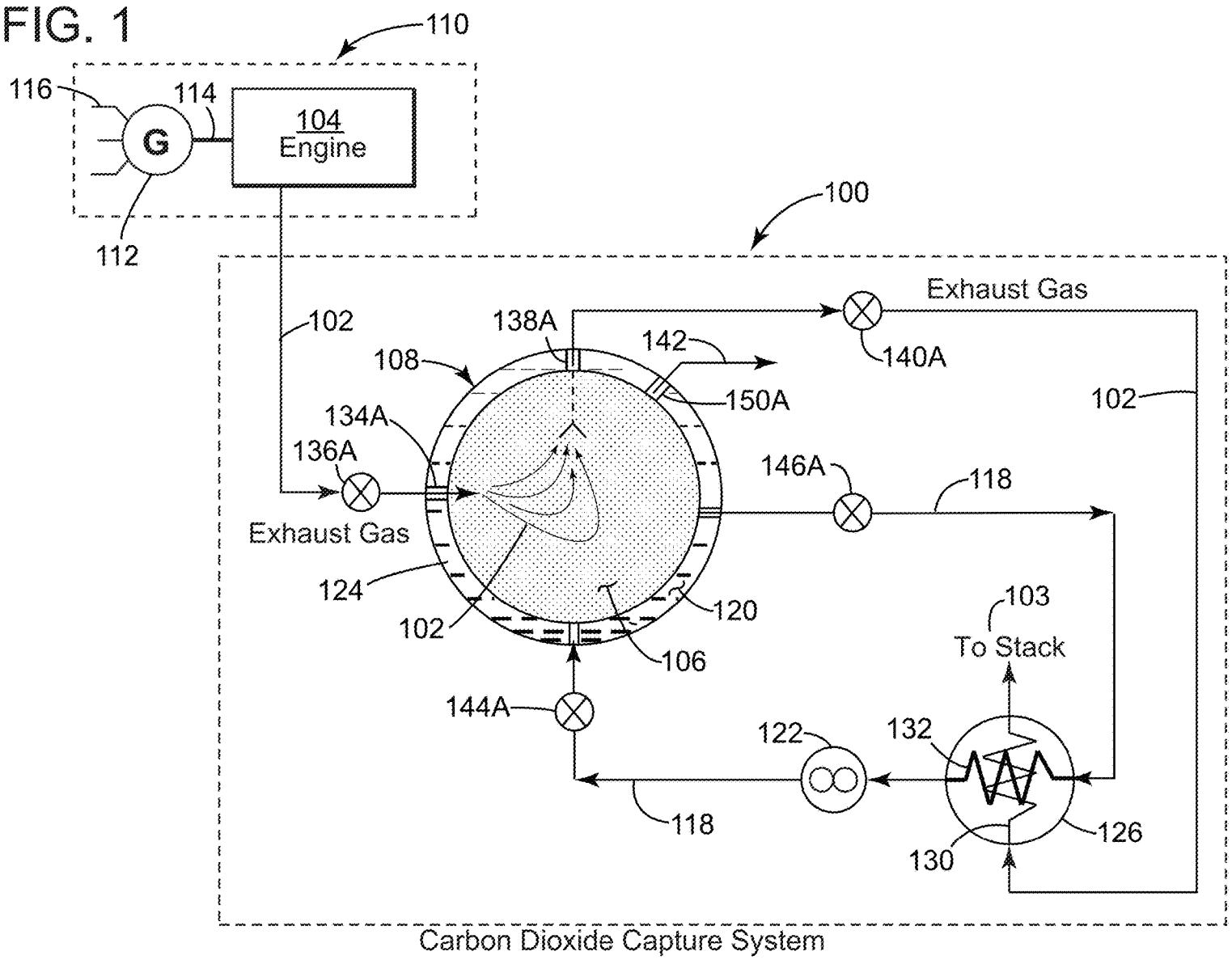
Figure 6:
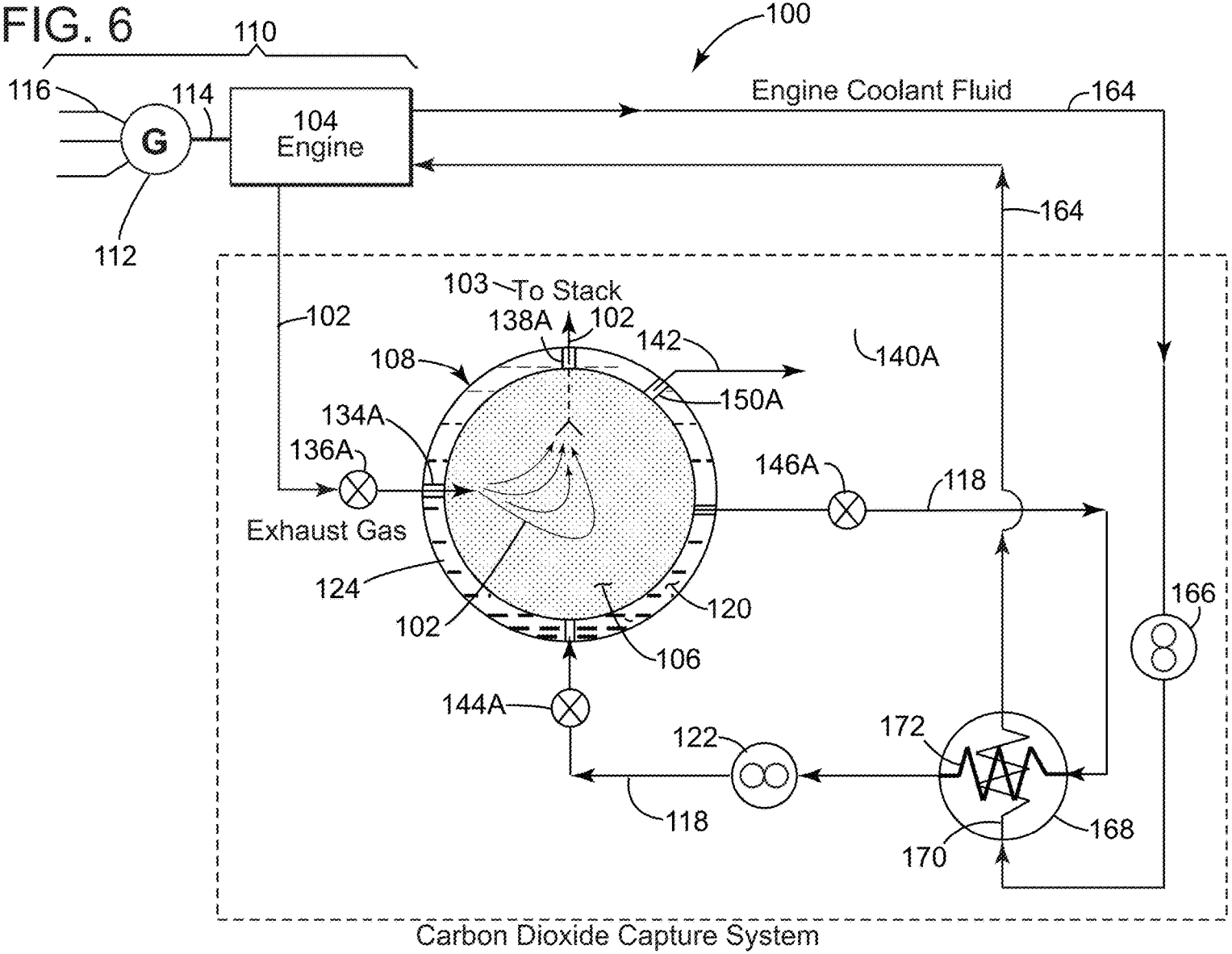
Figure 7:
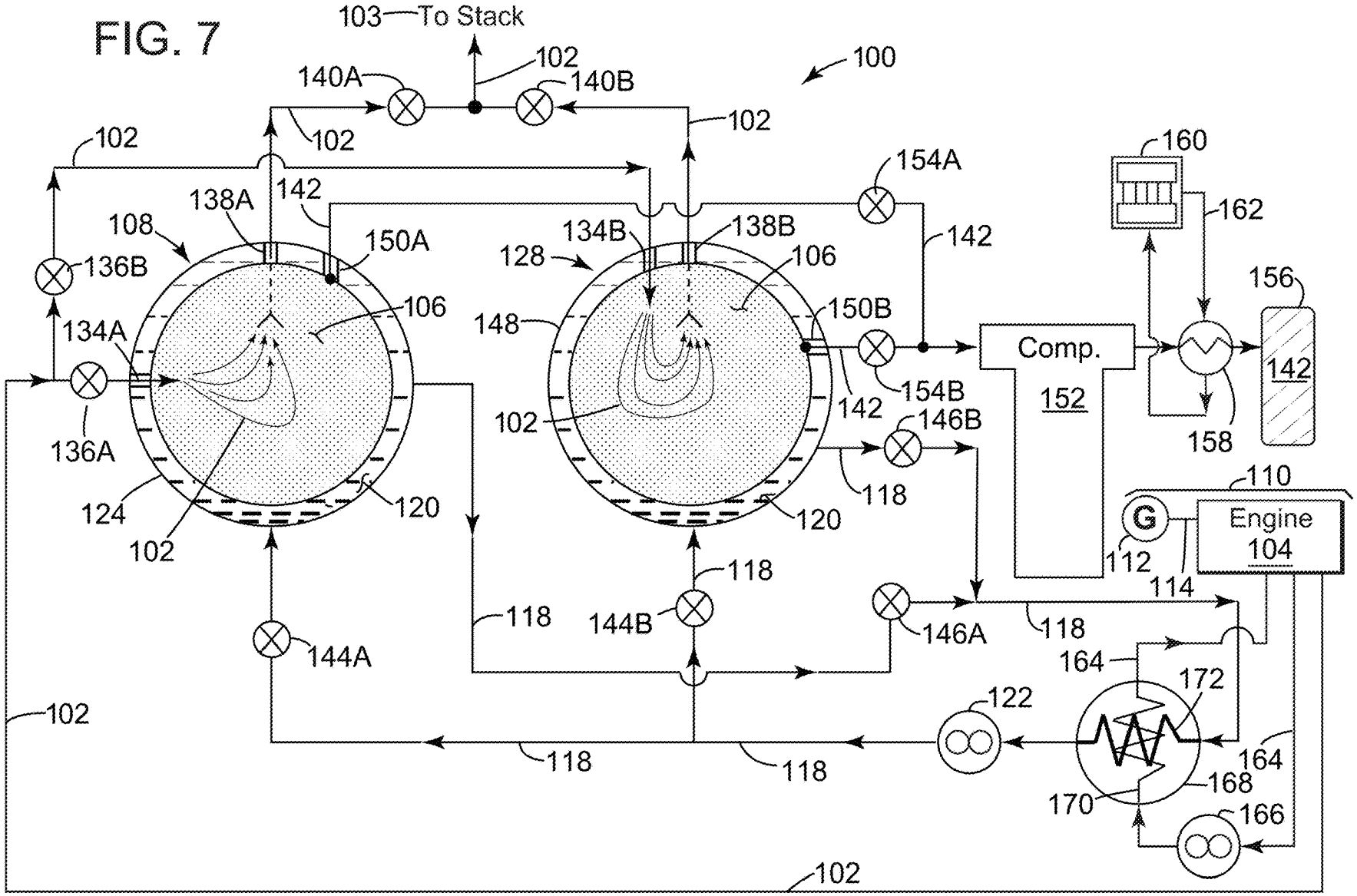
Figure 8:
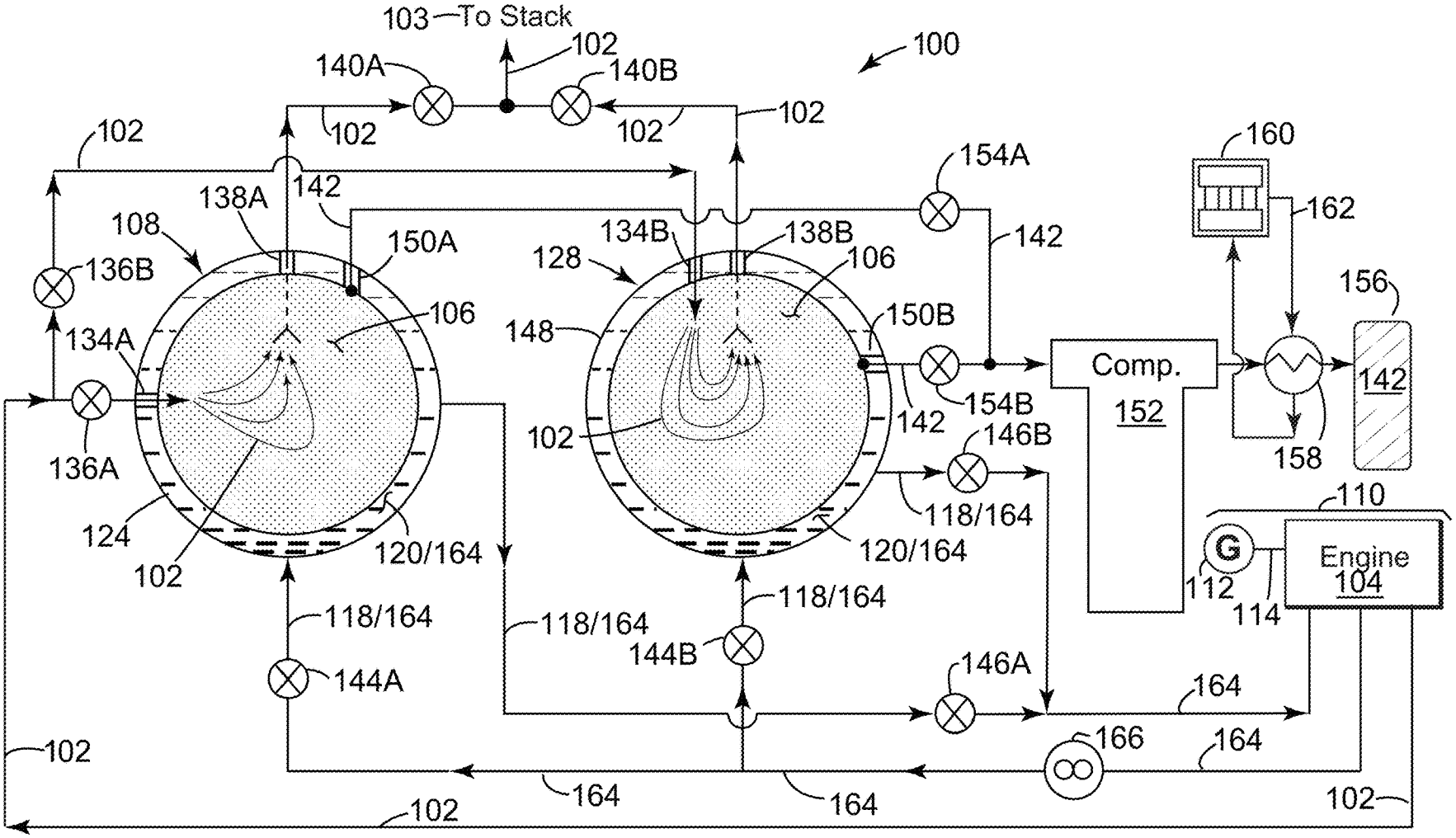
Figure 9:
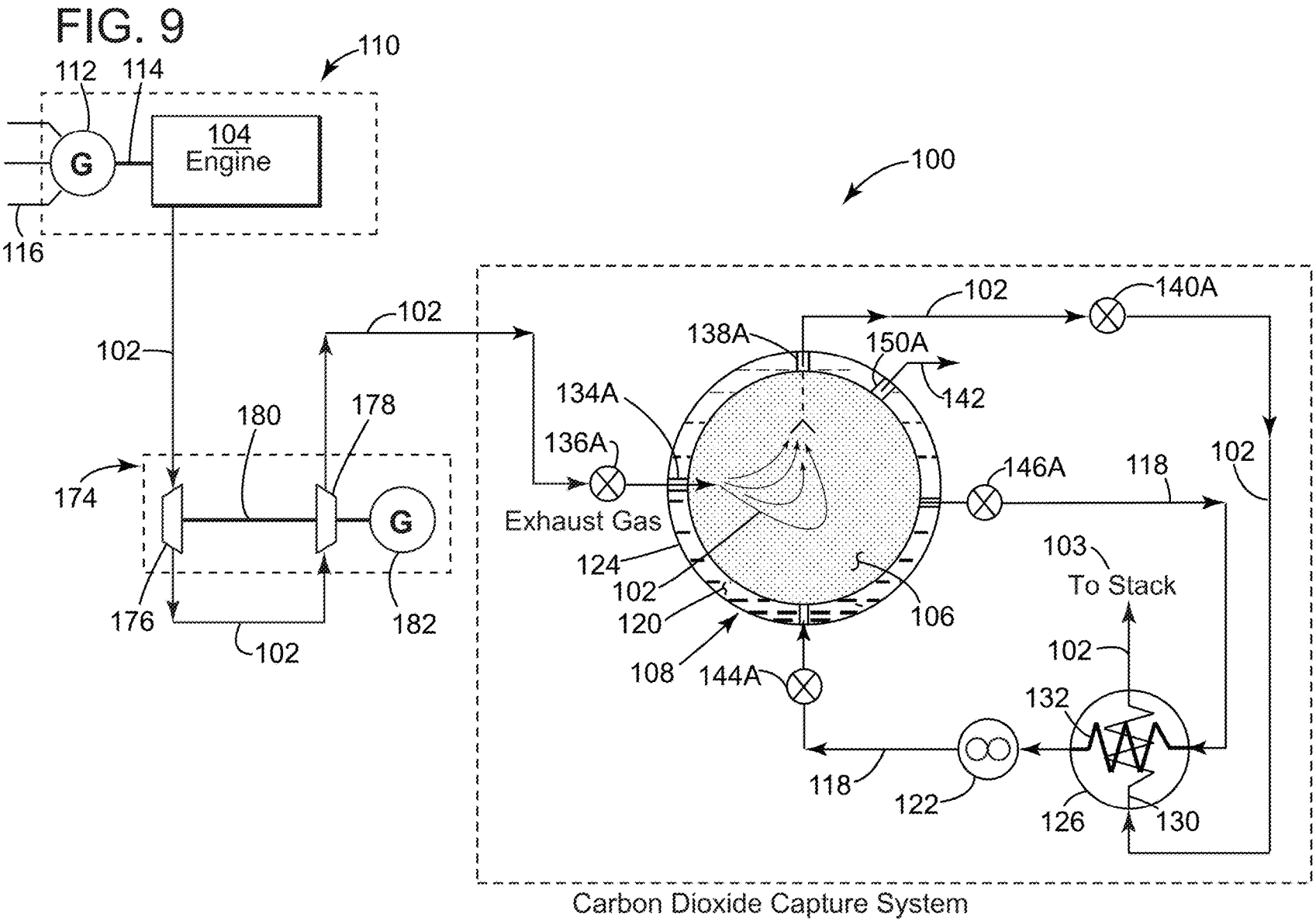
Figure 10:
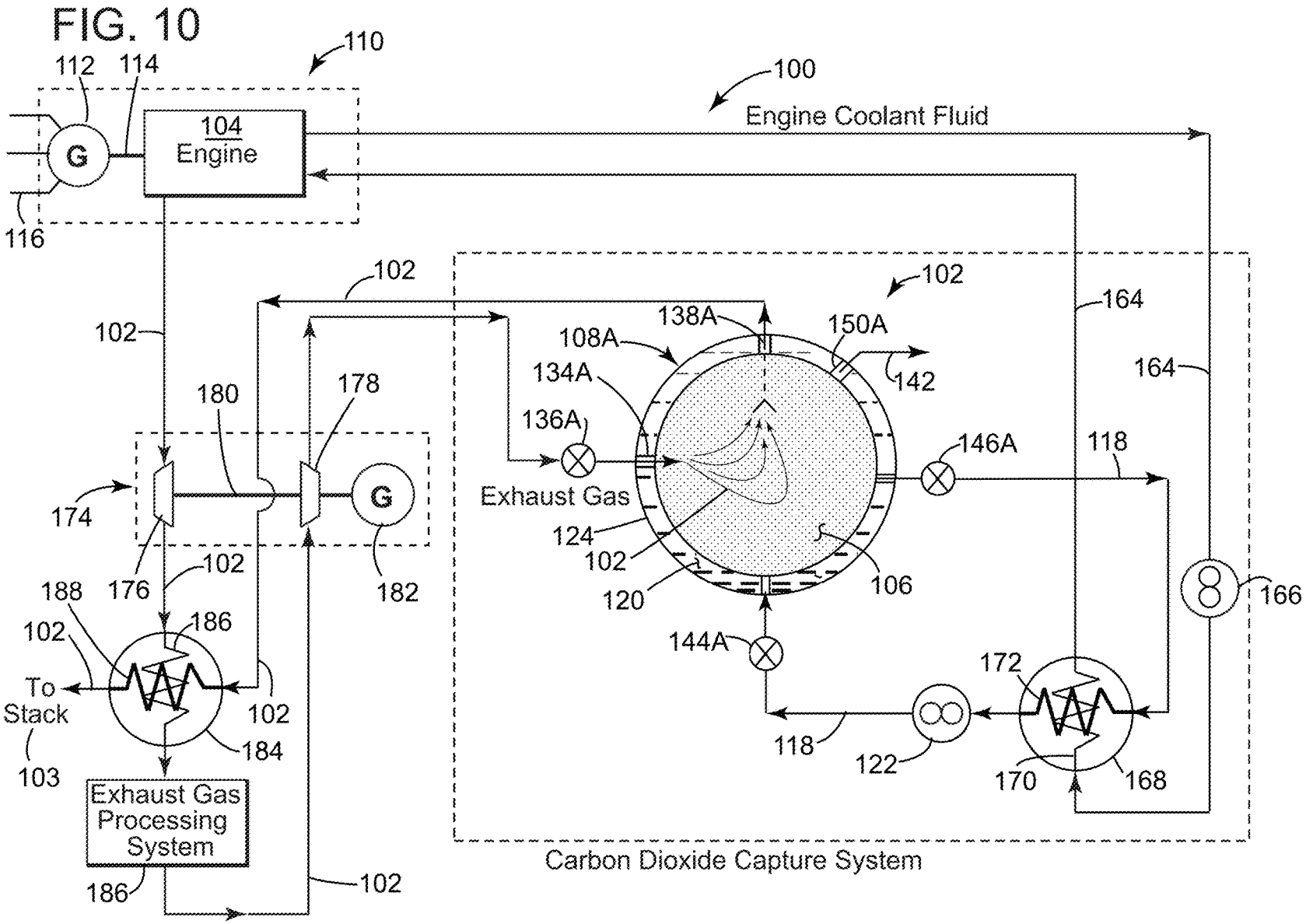
Figure 11:
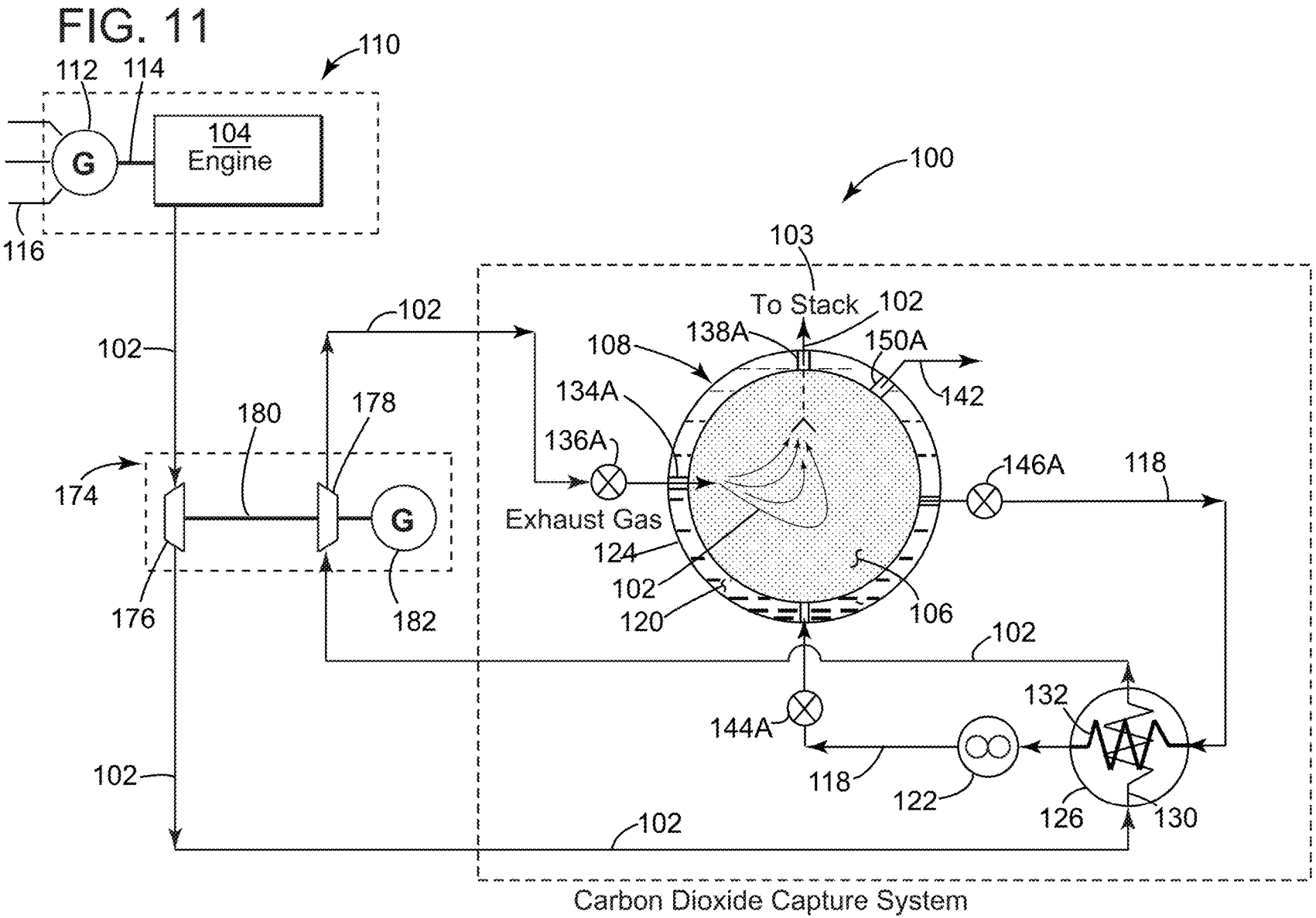

FIG. 6 depicts an example of a schematic view of at least a portion of a carbon dioxide capture system having a first capture tank with carbon dioxide absorbent material disposed therein, wherein the carbon dioxide capture system is removing carbon dioxide from a flow of exhaust gas from an internal combustion engine that is passing through the first capture tank and further utilizing heat from engine coolant from the internal combustion engine to regenerate the carbon dioxide according to aspects described herein;

FIG. 7 depicts an example of a schematic view of the carbon dioxide capture system of FIG. 6 having a first and a second capture tank, wherein the carbon dioxide capture system utilizes an engine coolant to heat exchange fluid heat exchanger to transfer heat from the engine coolant to a heat exchange fluid in a heat exchange loop that is in heat exchange communication with the first and second capture tanks, according to aspects described herein;

FIG. 8 depicts an example of a schematic view of the carbon dioxide capture system of FIG. 6 having a first and a second capture tank, wherein the engine coolant is the heat exchange fluid that is circulated in the heat exchange loop, according to aspects described herein;

FIG. 9 depicts an example of a schematic view of the carbon dioxide capture system of FIG. 1, which includes a turbine-generator system, which is utilized to supply power to the carbon dioxide capture system, in accordance with aspects described herein;

FIG. 10 depicts an example of a schematic view of the carbon dioxide capture system of FIG. 6, which includes a turbine-generator system, which is utilized to supply power to the carbon dioxide capture system, in accordance with aspects described herein;

FIG. 11 depicts another example of a schematic view of the carbon dioxide capture system of FIG. 1, which includes a turbine-generator system, which may be utilized to supply power to the carbon dioxide capture system, in accordance with aspects described herein.

Figure 12:
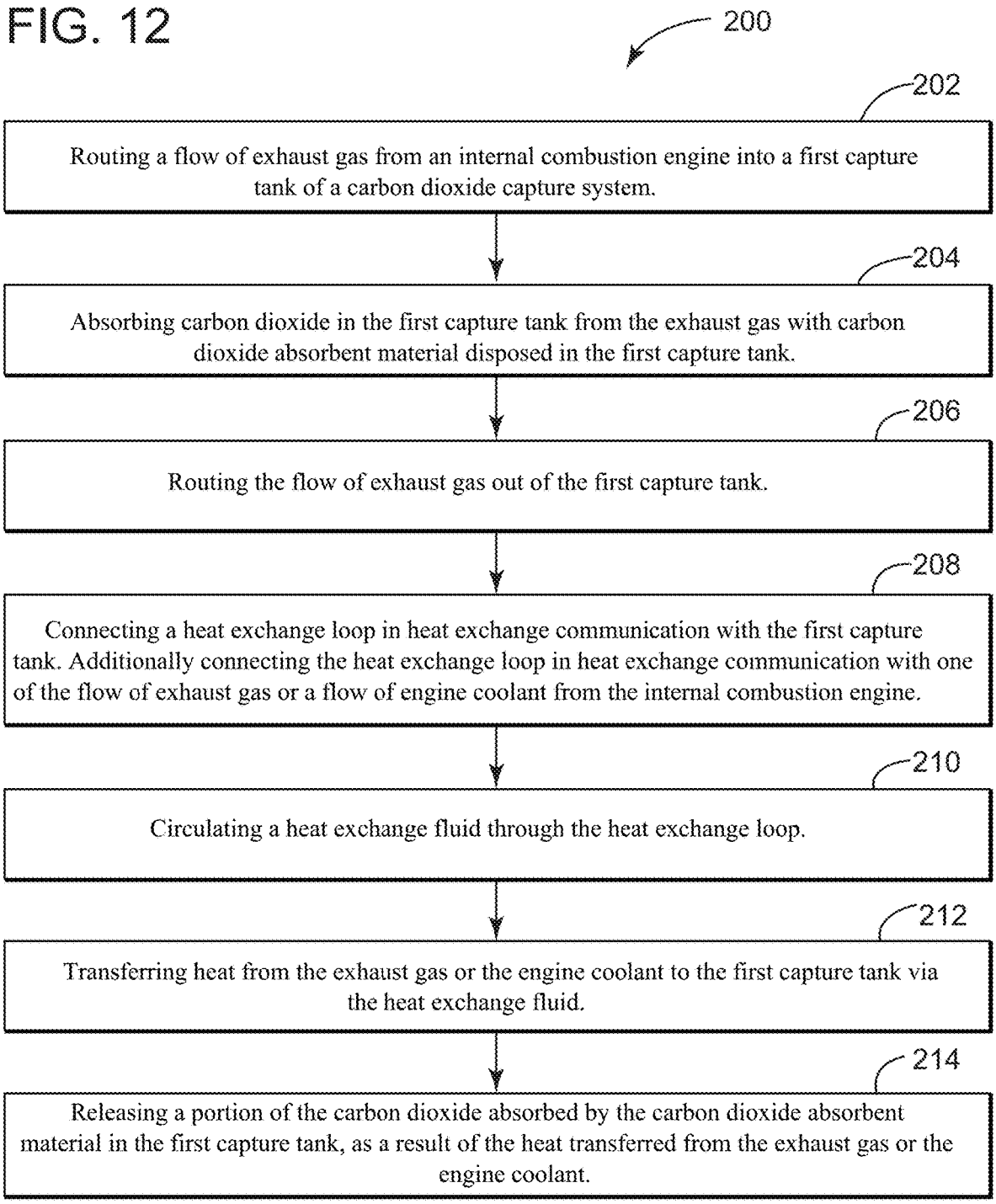
Figure 13:
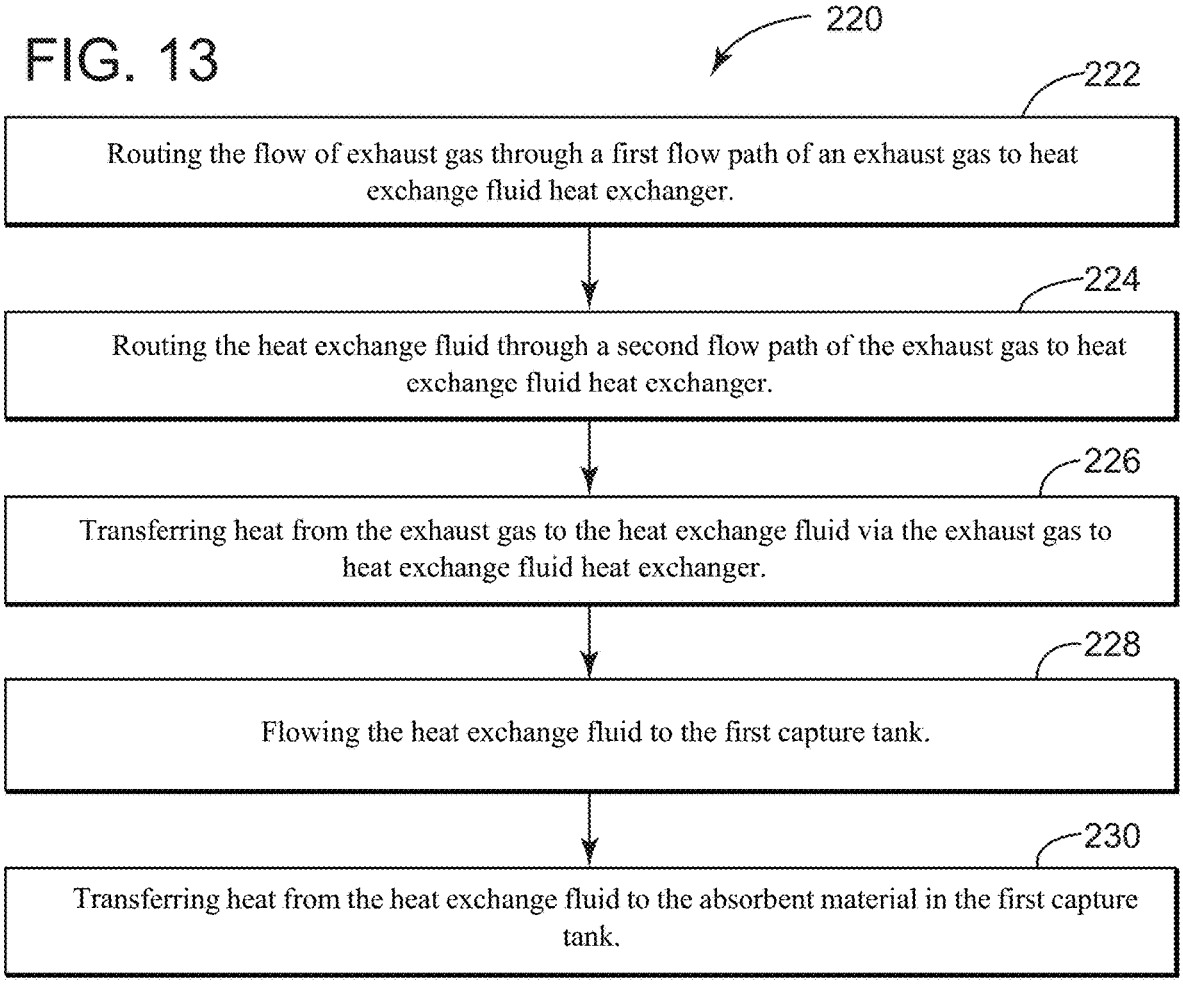
Figure 14:
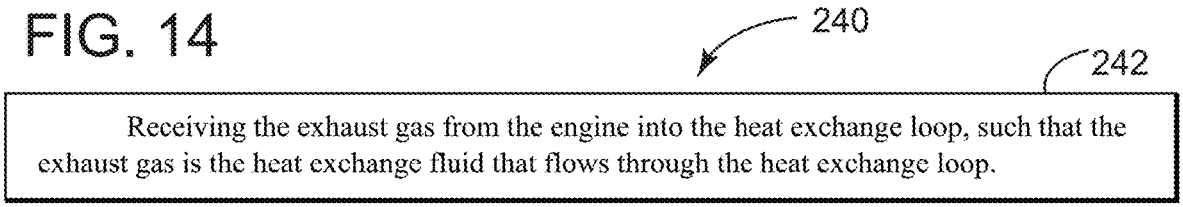
Figure 15:
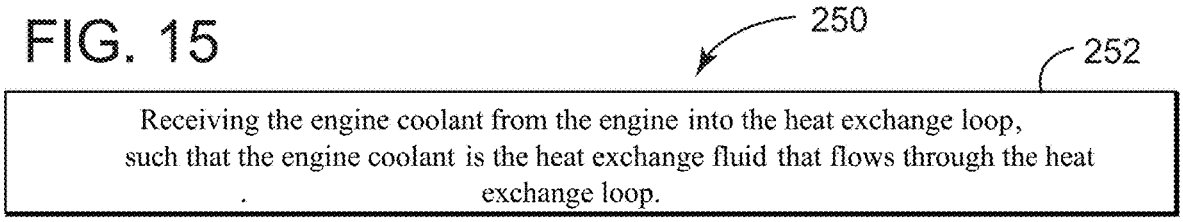
Figure 16:
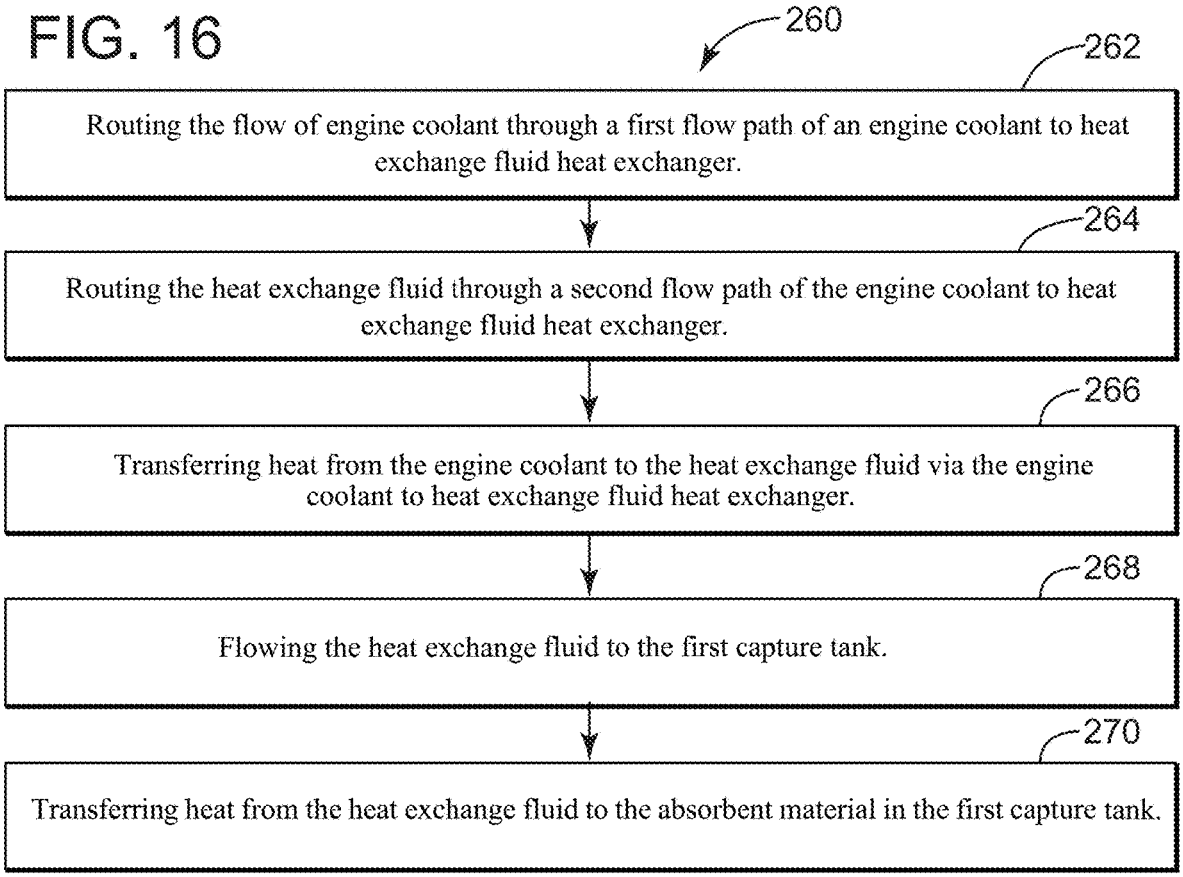
Figure 17:
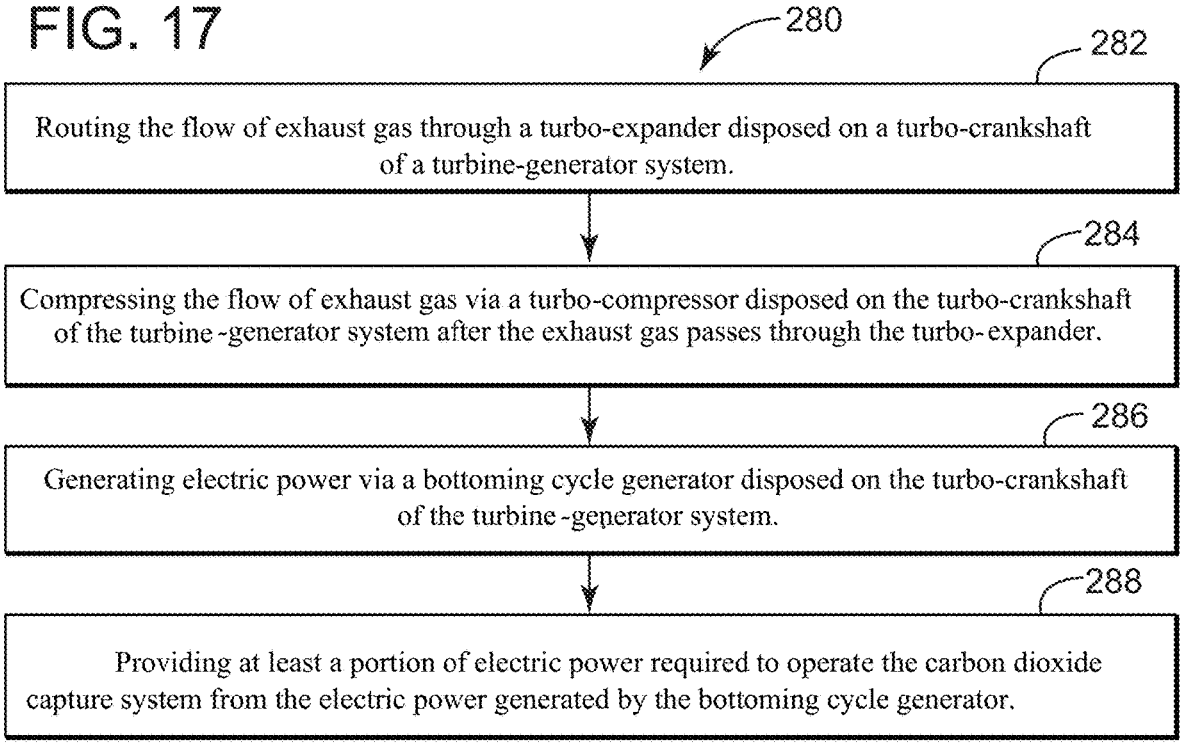
Figure 18:
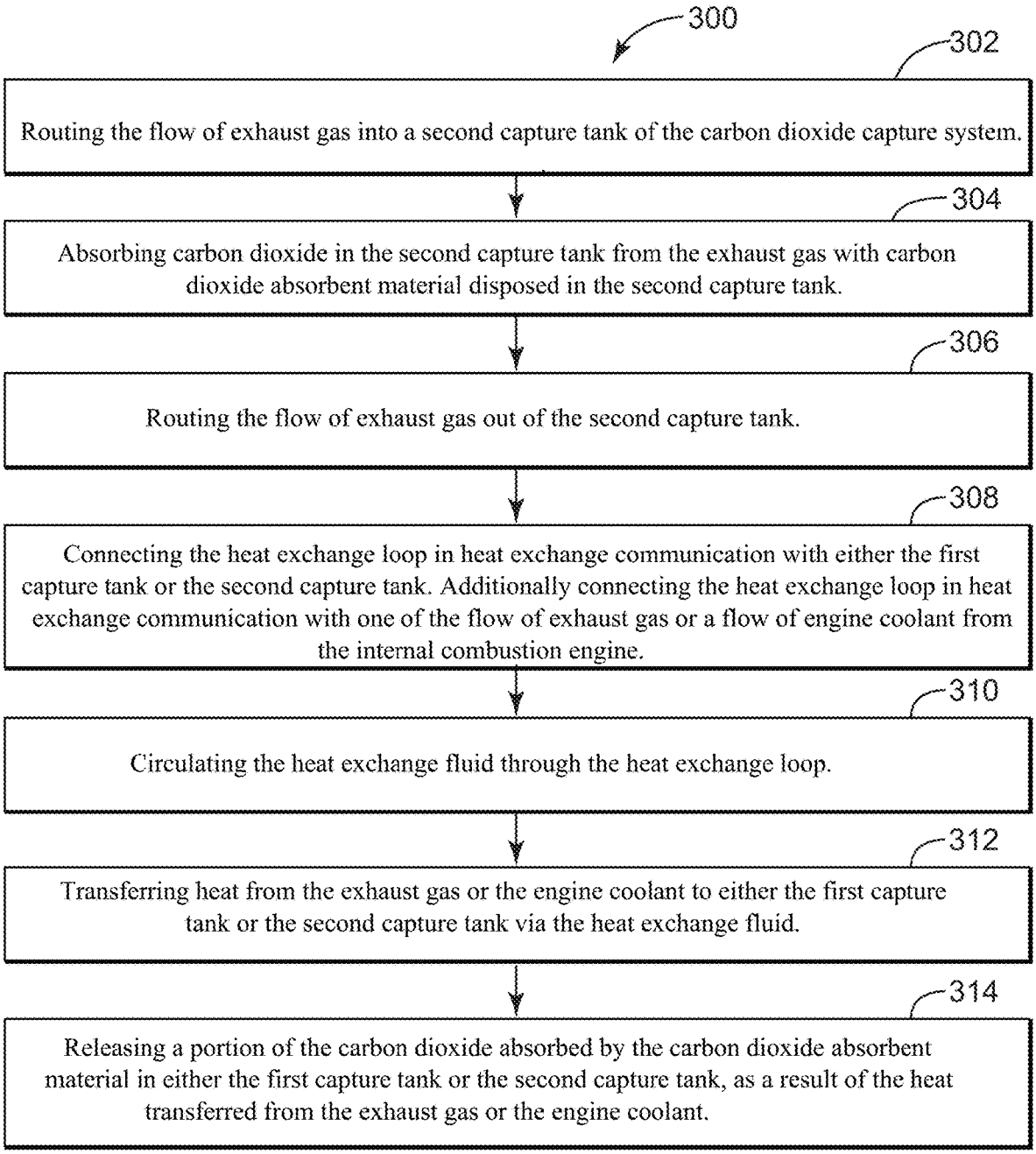
Figure 19:
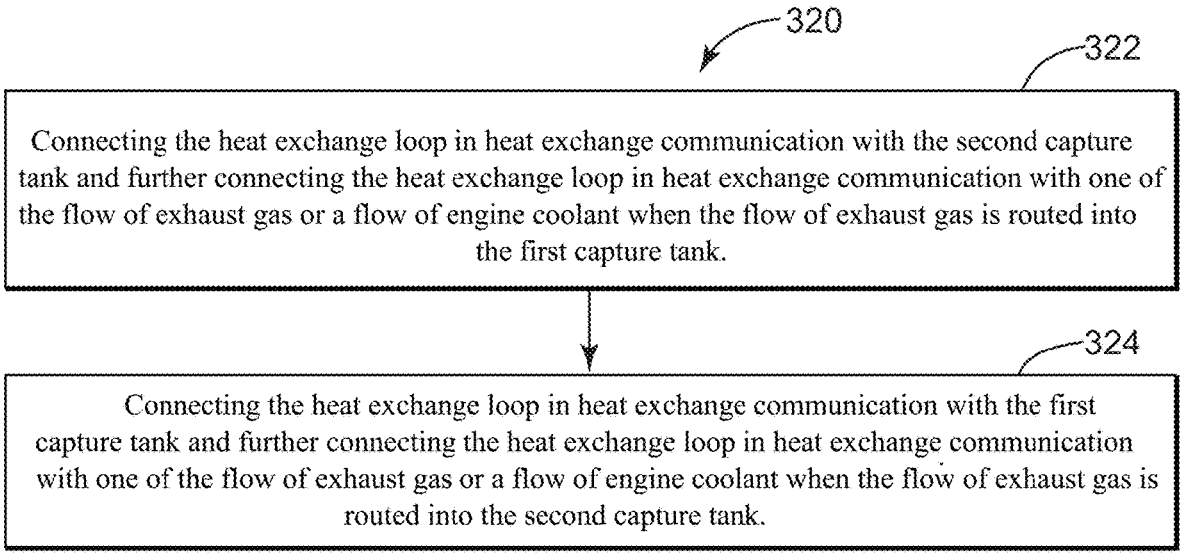
Figure 20:
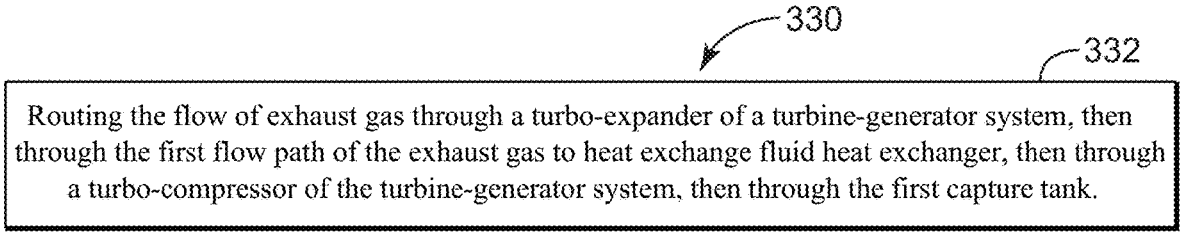

FIG. 12 depicts an example of a flow diagram of a method of capturing carbon dioxide from a flow of exhaust gas from an internal combustion engine, in accordance with aspects described herein;

FIG. 13 depicts an example of a continuation of the flow diagram of the method of FIG. 12, in accordance with aspects described herein;

FIG. 14 depicts an example of a continuation of the flow diagram of the method of FIG. 12, in accordance with aspects described herein;

FIG. 15 depicts an example of a continuation of the flow diagram of the method of FIG. 12, in accordance with aspects described herein;

FIG. 16 depicts an example of a continuation of the flow diagram of the method of FIG. 12, in accordance with aspects described herein;

FIG. 17 depicts an example of a continuation of the flow diagram of the method of FIG. 12, in accordance with aspects described herein;

FIG. 18 depicts an example of a continuation of the flow diagram of the method of FIG. 12, in accordance with aspects described herein;

FIG. 19 depicts an example of a continuation of the flow diagram of the method of FIG. 18, in accordance with aspects described herein; and FIG. 20 depicts an example of a continuation of the flow diagram of the method of FIG. 13, in accordance with aspects described herein.

DETAILED DESCRIPTION

Certain examples will now be described to provide an overall understanding of the principles of the structure, function, manufacture, and use of the methods, systems, and devices disclosed herein. One or more examples are illustrated in the accompanying drawings. Those skilled in the art will understand that the methods, systems, and devices specifically described herein and illustrated in the accompanying drawings are non-limiting examples and that the scope of the present disclosure is defined solely by the claims. The features illustrated or described in connection with one example maybe combined with the features of other examples. Such modifications and variations are intended to be included within the scope of the present disclosure.

The terms "significantly", "substantially", "approximately", "about", "relatively," or other such similar terms that may be used throughout this disclosure, including the claims, are used to describe and account for small fluctuations, such as due to variations in processing from a reference or parameter. Such small fluctuations include a zero fluctuation from the reference or parameter as well. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Referring to FIG. 1, an example is depicted of a schematic view of at least a portion of carbon dioxide capture system 100 according to aspects described herein. The carbon dioxide capture system 100 has at least a first capture tank 108 with carbon dioxide absorbent material 106 disposed therein. The carbon dioxide capture system 100 operates to remove carbon dioxide 142 from a flow of exhaust gas 102 from an internal combustion engine 104 that is passing through the first capture tank 108.

The flow of exhaust gas 102 to the first capture tank 108 is controlled by a flow valve 136A. When the flow valve 136A is open, the exhaust gas 102 enters the first capture tank 108 through an exhaust gas inlet port 134A of the first capture tank 108. Carbon dioxide 142 is then removed from the exhaust gas 102 upon contact with the carbon dioxide absorbent material 106 disposed within the first capture tank 108. The flow of exhaust gas then exits the first capture tank 108 through an exhaust gas outlet port 138A of the first capture tank 108.

The flow of exhaust gas 102 exiting the exhaust gas outlet port 138A is controlled by a flow valve 140A. When the flow valve 140A is open, the flow of exhaust gas 102 exiting the outlet port 138A is routed to a first flow path 130 of an "exhaust gas to heat exchange fluid heat exchanger" 126. The flow of exhaust gas 102 exiting the first flow path 130 is then routed up a stack 103 associated with the engine 104.

The engine 104 may be part of a primary power system 110 which includes a primary electric generator 112 that is operatively connected to the crankshaft 114 of the engine 104. The primary electric generator 112 may supply a primary electrical output 116 that may be used to supply electric power to, for example, a factory, an electrical grid system or a residence.

The internal combustion engine 104 may include a turbine engine, a piston engine or similar. The engine 104 utilizes fuel in a combustion process as the motive force that rotates the engine crankshaft 114 and the primary electric generator 112 to generate a primary electrical output 116. Additionally, the combustion process produces the flow of exhaust gas 102, which may be routed to the carbon dioxide capture system 100. The flow of exhaust gas 102 from the combustion process of the internal combustion engine 104 may be at, or near, atmospheric pressure and may have a temperature in the range of 850 to 950 degrees Fahrenheit (F). The engine 104 is cooled by an engine coolant 164 (see FIG. 6), such as glycol, water or the like, to keep the engine's operating temperature within a predetermined acceptable temperature range. After removing heat from the engine 104, the engine coolant 164 may have a temperature in the range of 230 degrees F. or less.

The carbon dioxide capture system 100 may utilize heat from the exhaust gas 102 to regenerate the carbon dioxide 142. Additionally, the carbon dioxide capture system 100 may also utilize heat from the engine coolant 164 (see FIG. 6) of the internal combustion engine 104 to regenerate the carbon dioxide 142. The regenerated carbon dioxide may exit the first capture tank 108 through carbon dioxide outlet port 150A. Advantageously, by utilizing waste heat from either the engine's exhaust gas 102 or engine coolant 164, the detrimental effect on the efficiency of the engine 104 by the heating process required to regenerate the carbon dioxide 142 is greatly reduced.

The carbon dioxide absorbent material 106 may be composed of such materials as zeolite, metal organic frameworks material, calcium hydroxide or the like. As used herein, carbon dioxide absorbent material 106 may include any material that has a physical or chemical affinity for carbon dioxide 142. The carbon dioxide absorbent material 106 may remove carbon dioxide 142 from the flow of exhaust gas 102 by several different processes. For example, the carbon dioxide absorbent material 106 may remove the carbon dioxide 142 from the exhaust gas 102 by the process of absorption, wherein the carbon dioxide is dissolved by a liquid or solid absorbent. An example of such an absorbent material may be calcium hydroxide. Also, by way of example, the carbon dioxide absorbent material 106 may remove the carbon dioxide 142 from the exhaust gas 102 by the process of adsorption, wherein the carbon dioxide molecules adhere to the surface of the adsorbent. An example of such an adsorbent material may be zeolite.

The carbon dioxide absorbent materials 106 that remove carbon dioxide utilizing the adsorption process, may later regenerate (or release) the carbon dioxide at fairly low temperature ranges. For example, such adsorbent materials may release the carbon dioxide when heated to temperature ranges of 220 degrees Fahrenheit (F) or lower. This may be advantageous when utilizing heat from the engine coolant 164 (see FIG. 6) of the internal combustion engine 104 to regenerate the carbon dioxide 142, since the engine coolant 164 may have an operating temperature that is about 230 degrees F. or lower.

The carbon dioxide capture system 100 also includes a heat exchange loop 118 that is in heat exchange communication with the first capture tank 108. The heat exchange loop 118 is also in heat exchange communication with either the flow of exhaust gas 102 (as shown in FIG. 1) or a flow of engine coolant 164 (as shown in FIG. 6) from the internal combustion engine 104. A heat exchange fluid 120 is operable to flow through the heat exchange loop 118 via heat exchange fluid pump 122.

The heat exchange fluid 120 may be glycol, water or other similar fluid. As will be described in greater detail herein, the heat exchange fluid 120 may also be the exhaust gas 102 itself, or the engine coolant 164 itself, from the engine 104.

The heat exchange fluid 120 operates to transfer heat from the exhaust gas 102 or the engine coolant 164 to the first capture tank 108. The heat from the exhaust gas 102 or the engine coolant 164 operates to release a portion of the carbon dioxide 142 absorbed by the carbon dioxide absorbent material 106 in the first capture tank 108.

In heat exchange communication, as used herein, includes any structure, device or method that transfers heat energy from one structure or substance to another. In the example illustrated in FIG. 1, the heat exchange loop 118 is in heat exchange communication with the first capture tank through a first capture tank heating jacket 124, which partially, or entirely, surrounds the first capture tank 108 and through which the heat exchange fluid 120 flows. Additionally, as illustrated in the example of FIG. 1, the heat exchange loop 118 is in heat exchange communication with the exhaust gas 102 through the "exhaust gas to heat exchange fluid heat exchanger" 126, which transfers heat energy from the exhaust gas 102 to the heat exchange fluid 120.

More specifically, the flow of heat exchange fluid 120 is controlled by flow valves 144A and 146A. When flow valves 144A and 146A are open, the heat exchange fluid pump 122 is operable to circulate the heat exchange fluid 120 through the heat exchange loop 118 from the heating jacket 124 of the first capture tank 108 to a second flow path 132 of the exhaust gas to heat exchange fluid heat exchanger 126. The exhaust gas 102 entering the first flow path 130 will transfer its heat energy to the heat exchange fluid 120 entering the second flow path 132. The heat exchange fluid 120 will then flow from the second flow path 132 and through the heating jacket 124 of the first capture tank. The heat exchange fluid 120 will then transfer the heat energy picked up from the exhaust gas 102 in the exhaust gas to heat exchange fluid heat exchanger 126 to the carbon dioxide absorption material 106 in the first capture tank.

Figure 2:
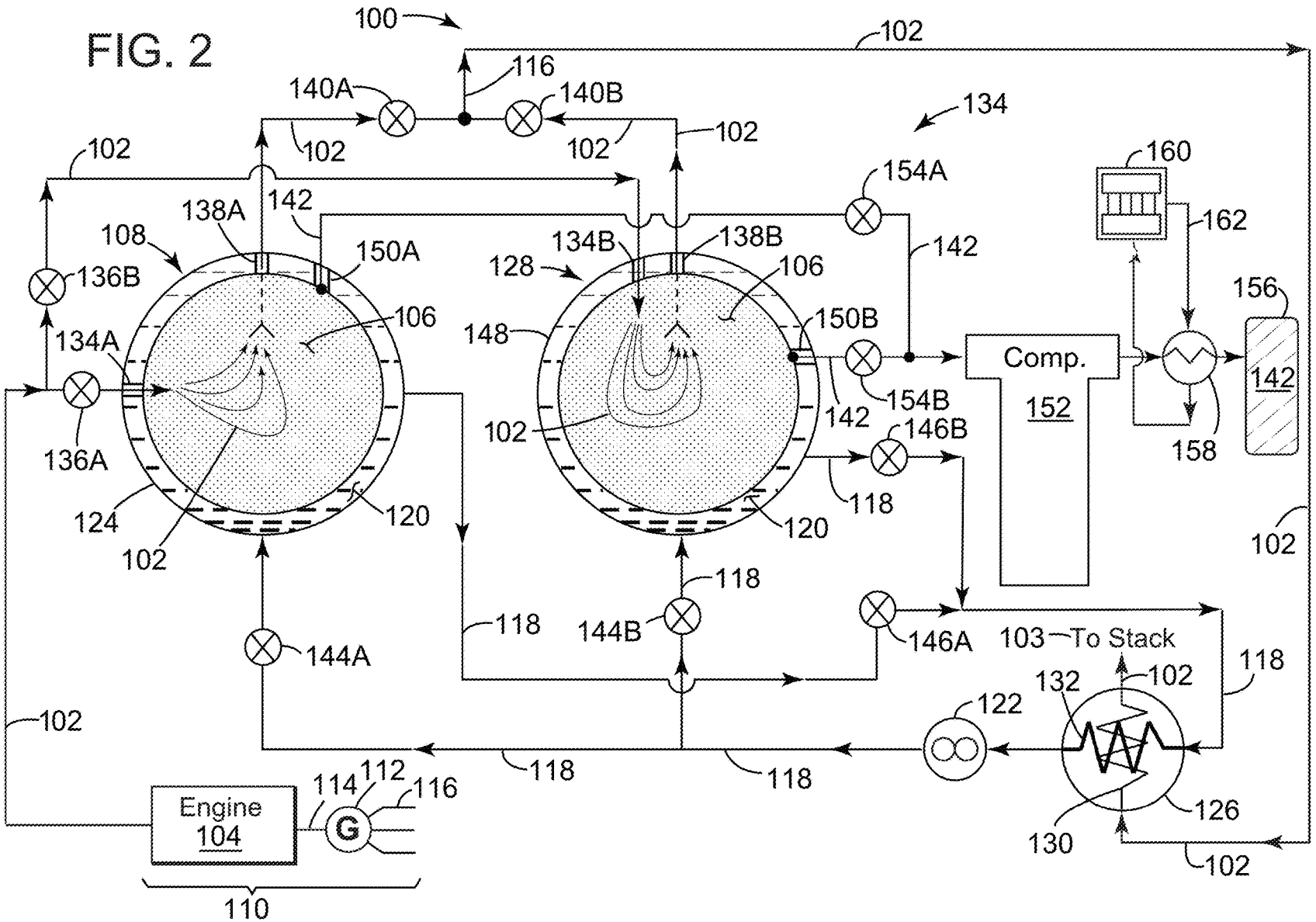

Referring to FIG. 2, an example is depicted of a more detailed schematic view of the carbon dioxide capture system 100 of FIG. 1, according to aspects described herein. The carbon dioxide capture system 100 of FIG. 2 has a first capture tank 108 and a second capture tank 128, both of which have carbon dioxide absorption material 106 disposed therein. As illustrated in FIG. 2, the carbon dioxide capture system 100 utilizes an exhaust gas to heat exchange fluid heat exchanger 126 to transfer heat from the exhaust gas 102 to the heat exchange fluid 120 in the heat exchange loop 118, which is in heat exchange communication with the first and second capture tanks 108, 128.

The exhaust gas to heat exchange fluid heat exchanger 126 includes a first flow path 130 and a second flow path 132 which operate to exchange heat therebetween. The first flow path 130 operates to receive therethrough the flow of exhaust gas 102 from the engine 104 and/or primary power system 110. In the example illustrated in FIG. 2, the exhaust gas 102 is then routed to the stack 103 (or chimney stack system) associated with the engine 104, after the exhaust gas 102 exits the first flow path 130 of the exhaust gas to heat exchange fluid heat exchanger 126.

The stack 103, as used herein, will refer to the extended exhaust piping system (or chimney stack system) designed to route exhaust gas 102 away from the source of the combustion process (in this example, the source of the combustion process is the internal combustion engine 104). In the example illustrated in FIG. 2, the stack 103 of the internal combustion engine is designed to route the flow of exhaust gas 102 away from the primary power system 110 after the exhaust gas exits the first flow path 130 of the exhaust gas to heat exchange fluid heat exchanger 126.

The second flow path 132 operates to receive therethrough the flow of heat exchange fluid 120 in the heat exchange loop 118. The exhaust gas to heat exchange fluid heat exchanger 126 operates to transfer heat from the exhaust gas 102 to the heat exchange fluid 120. The heat exchange loop 118 operates to flow the heat exchange fluid 120 selectively to the first capture tank 108 and the second capture tank 128 via the heat exchange fluid pump 122 and flow valves 144A, 144B, 146A and 146B. The flow valves 144A and 146A control flow of the heat exchange fluid 120 in the heat exchange loop 118 through the heating jacket 124 of the first capture tank 108. The flow valves 144B and 146B control flow of the heat exchange fluid 120 through a similar heating jacket 148 of the second capture tank 128. The heat exchange loop 118 also operates to selectively transfer heat from the heat exchange fluid 120 to the carbon dioxide absorbent material 106 in either the first capture tank 108 or the second capture tank 128 via the heating jackets 124 and 148.

For purposes herein, a heating jacket (such as jackets 124 and 148) may refer to an outer casing or system of tubing, which holds fluid and through which the fluid circulates to heat a vessel or device. For example, the first and second capture tank heating jackets 124 and 148 may be casings or systems of tubing, which are operable to transfer heat from the exhaust gas 102 or engine coolant 164 to the selected first or second capture tanks 108, 128 and to heat the carbon dioxide 142 captured within the selected tank 108, 128.

The heating jackets 124 and 148 are operable to selectively contain and circulate the heat exchange fluid 120 (which is heated with the heat from the exhaust gas 102 or engine coolant 164 from engine 104) around the outer surfaces of the first or second capture tanks 108, 128 respectively to heat the selected capture tank 108, 128. The heat exchange fluid 120 will add the heat from the exhaust gas 102 or engine coolant 164 to the selected capture tank 108, 128. The heat from either the exhaust gas 102 or engine coolant 164 from the engine 104 will then advantageously be used to regenerate (or desorb) a portion, or substantially all, of the carbon dioxide 142 from the carbon dioxide absorbent material 106 disposed in capture tanks 108, 128, so that the carbon dioxide 142 may be pumped by a compressor 152 into a holding tank 156 for later use, storage and/or disposal.

In the example illustrated in FIG. 2, the carbon dioxide capture system 100 may be configured such that the flow of exhaust gas 102 passes through the first capture tank 108 prior to the flow of exhaust gas 102 passing through the first flow path 130 of the exhaust gas to heat exchange fluid heat exchanger 126. However, as will be seen in FIG. 3, the carbon dioxide capture system 100 may also be configured such that the flow of exhaust gas 102 passes through the first flow path 130 of the exhaust gas to heat exchange fluid heat exchanger 126 prior to the flow of exhaust gas 102 passing the first capture tank 108.

The first capture tank 108 includes an exhaust gas inlet port 134A that is selectively connected to the flow of exhaust gas 102 from the engine 104 via the flow valve 136A. The exhaust gas 102 passes through the exhaust gas inlet port 134A prior to the exhaust gas 102 passing through the carbon dioxide absorbent material 106 in the first capture tank 108. The first capture tank 108 also includes an exhaust gas outlet port 138A that is connected to the flow of exhaust gas 102 after the flow of exhaust gas 102 has passed through carbon dioxide absorbent material 106 in the first capture tank 108. The exhaust gas 102 leaving the outlet port 138A may be connected to the first flow path 130 of the exhaust gas to heat exchange fluid heat exchanger 126 via flow valve 140A.

The second capture tank 128 includes an exhaust gas inlet port 134B that is selectively connected to the flow of exhaust gas 102 from the engine via flow valve 136B. The exhaust gas 102 passes through the exhaust gas inlet port 134B prior to the exhaust gas 102 passing through the carbon dioxide absorbent material 106 in the second capture tank 128. The second capture tank 128 also includes an exhaust gas outlet port 138B that is connected to the flow of exhaust gas 102 after the flow of exhaust gas 102 has passed through carbon dioxide absorbent material 106 in the second capture tank 128. The exhaust gas 102 leaving the outlet port 138B may be connected to the first flow path 130 of the exhaust gas to heat exchange fluid heat exchanger 126 via flow valve 140B.

As will be explained in greater detail herein, the heat exchange loop 118 may be selectively in heat exchange communication with either the first capture tank 108 or the second capture tank 128 via the series of flow valves 144A, 144B, 146A and 146B. Additionally, the heat exchange fluid 120 may operate to transfer heat from the exhaust gas 102 or the engine coolant 164 (see FIG. 7) to either the first capture tank 108 or the second capture tank 128. Further, the heat from the exhaust gas 102 or the engine coolant 164 may operate to release a portion of the carbon dioxide 142 absorbed by the carbon dioxide absorbent material 106 in either the first capture tank 108 or the second capture tank 128.

When the flow valve 136B is closed and flow valve 136A is open, the exhaust gas inlet port 134A of the first capture tank 108 is selectively connected to the flow of exhaust gas 102 from the engine 104. When the first capture tank 108 is receiving exhaust gas 102 from the engine 104, then the flow valve 140A is open and flow valve 140B is closed to selectively connect the exhaust gas outlet port 138A of the first capture tank 108 to the first flow path 130 of the exhaust gas to heat exchange fluid heat exchanger 126. Additionally, the flow valves 144B and 146B are opened and flow valves 144A and 146A are closed to enable flow of the heat exchange fluid 120 through the heating jacket 148 of the second capture tank 128. Accordingly, in this configuration, the heat exchange loop 118 is connected in heat exchange communication with the second capture tank 128 such that the heat exchange fluid 120 operates to transfer heat from the exhaust gas 102 or the engine coolant 164 to the second capture tank 128. The heat from the exhaust gas 102 or the engine coolant 164 operates to release a portion of the carbon dioxide 142 absorbed by the carbon dioxide absorbent material 106 in the second capture tank 128.

Alternatively when the flow valve 136A is closed and flow valve 136B is open, the exhaust gas inlet port 134B of the second capture tank 128 is selectively connected to the flow of exhaust gas 102 from the engine 104. When the second capture tank 128 is receiving exhaust gas 102 from the engine 104, then the flow valve 140B is open and flow valve 140A is closed to selectively connect the exhaust gas outlet port 138B of the second capture tank 128 to the first flow path 130 of the exhaust gas to heat exchange fluid heat exchanger 126. Additionally, flow valves 144A and 146A are opened and flow valves 144B and 146B are closed to enable flow of the heat exchange fluid 120 through the heating jacket 124 of the first capture tank 108. Accordingly, in this configuration, the heat exchange loop 118 is connected in heat exchange communication with the first capture tank 108 such that the heat exchange fluid 120 operates to transfer heat from the exhaust gas 102 or the engine coolant 164 to the first capture tank 108. The heat from the exhaust gas 102 or the engine coolant 164 operates to release a portion of the carbon dioxide 142 absorbed by the carbon dioxide absorbent material 106 in the first capture tank 108.

The first and second capture tanks 108, 128 also include a carbon dioxide outlet port 150A and 150B, which are selectively connectable to a carbon dioxide compressor 152. More specifically, flow valve 154A controls flow of regenerated carbon dioxide 142 out of the carbon dioxide outlet port 150A of the first capture tank 108 and into the carbon dioxide compressor 152. Additionally, flow valve 154B controls flow of regenerated carbon dioxide 142 out of the carbon dioxide outlet port 150B of the second capture tank 128 and into the carbon dioxide compressor 152. The carbon dioxide compressor 152 is operable to pump carbon dioxide 142 out of the carbon dioxide outlet ports 150A, 150B that the carbon dioxide compressor 152 is connected to and into the holding tank 156 for later use, storage and/or disposal. The carbon dioxide compressor 152 may be a rotary screw type compressor, a piston compressor or the like.

A carbon dioxide heat exchanger 158 may be disposed between the holding tank 156 and the carbon dioxide compressor 152 to cool the carbon dioxide 142 prior to entering the holding tank 156. The carbon dioxide heat exchanger 158 may be cooled by a cooling tower 160 that circulates coolant fluid between the cooling tower 160 and the carbon dioxide heat exchanger 158 via carbon dioxide heat exchanger coolant loop 162.

During operation, the various flow valves 136A, 136B, 140A, 140B, 144A, 144B, 146A, 146B, 154A and 154B may be configured such that the exhaust gas inlet port 134A of the first capture tank 108 is connected (i.e., in fluid communication) to the flow of exhaust gas 102 from the engine 104. In other words, the exhaust gas inlet port 134A is connected to the flow of exhaust gas 102 prior to the exhaust gas 102 passing through the carbon dioxide absorbent material 106 in the first capture tank 108. Additionally, the first capture tank's exhaust gas outlet port 138A is connected (i.e., in fluid communication) to the first flow path 130 of the exhaust gas to heat exchange fluid heat exchanger 126. In other words, the exhaust gas outlet port 138A is connected to the flow of exhaust gas 102 after the exhaust gas has passed through the carbon dioxide absorbent material 106 in the first capture tank 108. Additionally, the carbon dioxide compressor 152 may be connected to the carbon dioxide outlet port 150B of the second capture tank 128. The heat exchange loop 118 may be connected between the exhaust gas to heat exchange fluid heat exchanger 126 and the second capture tank 128. In this configuration, exhaust gas 102 will flow into the first capture tank 108 to remove the carbon dioxide 142 from the exhaust gas 102 flow prior to entering the exhaust gas to heat exchange fluid heat exchanger 126. The exhaust gas to heat exchange fluid heat exchanger 126 will transfer heat from the exhaust gas 102 into the heat exchange fluid 120, which will be pumped via pump 122 through the heat exchange loop 118 to the heating jacket 148 of the second capture tank 128. Accordingly, the heat from the exhaust gas 102 will advantageously be used to heat the second capture tank 128 to regenerate the carbon dioxide from the second capture tank 128 and to pump the carbon dioxide 142 into the holding tank 156. By using the heat from the exhaust gas 102 to regenerate the carbon dioxide in the second capture tank 128, the energy needed from external sources (such as electric heaters or the like) to regenerate the carbon dioxide 142 is advantageously reduced.

Also during operation, the various flow valves 136A, 136B, 140A, 140B, 144A, 144B, 146A, 146B, 154A and 154B may be configured such that the exhaust gas inlet port 134B of the second capture tank 128 is connected (i.e., in fluid communication) to the flow of exhaust gas 102 from the engine 104. In other words, the exhaust gas inlet port 134B is connected to the flow of exhaust gas 102 prior to the exhaust gas 102 passing through the carbon dioxide absorbent material 106 in the second capture tank 128. Additionally, the second capture tank's exhaust gas outlet port 138B is connected (i.e., in fluid communication) to the first flow path 130 of the exhaust gas to heat exchange fluid heat exchanger 126. In other words, the exhaust gas outlet port 138B is connected to the flow of exhaust gas 102 after the exhaust gas has passed through the carbon dioxide absorbent material 106 in the second capture tank 128. Additionally, the carbon dioxide compressor 152 may be connected to the carbon dioxide outlet port 150A of the first capture tank 108. The heat exchange loop 118 may be connected between the exhaust gas to heat exchange fluid heat exchanger 126 and the first capture tank 128. In this configuration, exhaust gas 102 will flow into the second capture tank 128 to remove the carbon dioxide 142 from the exhaust gas 102 flow prior to entering the exhaust gas to heat exchange fluid heat exchanger 126. The exhaust gas to heat exchange fluid heat exchanger 126 will transfer heat from the exhaust gas 102 into the heat exchange fluid 120, which will be pumped via pump 122 through the heat exchange loop 118 to the heating jacket 124 of the first capture tank 108. Accordingly, the heat from the exhaust gas 102 will advantageously be used to heat the first capture tank 108 to regenerate the carbon dioxide from the first capture tank 108 and to pump the carbon dioxide 142 into the holding tank 156. By using the heat from the exhaust gas 102 to regenerate the carbon dioxide in the first capture tank 108, the energy needed from external sources (such as electric heaters or the like) to regenerate the carbon dioxide 142 is advantageously reduced.

Figure 3:
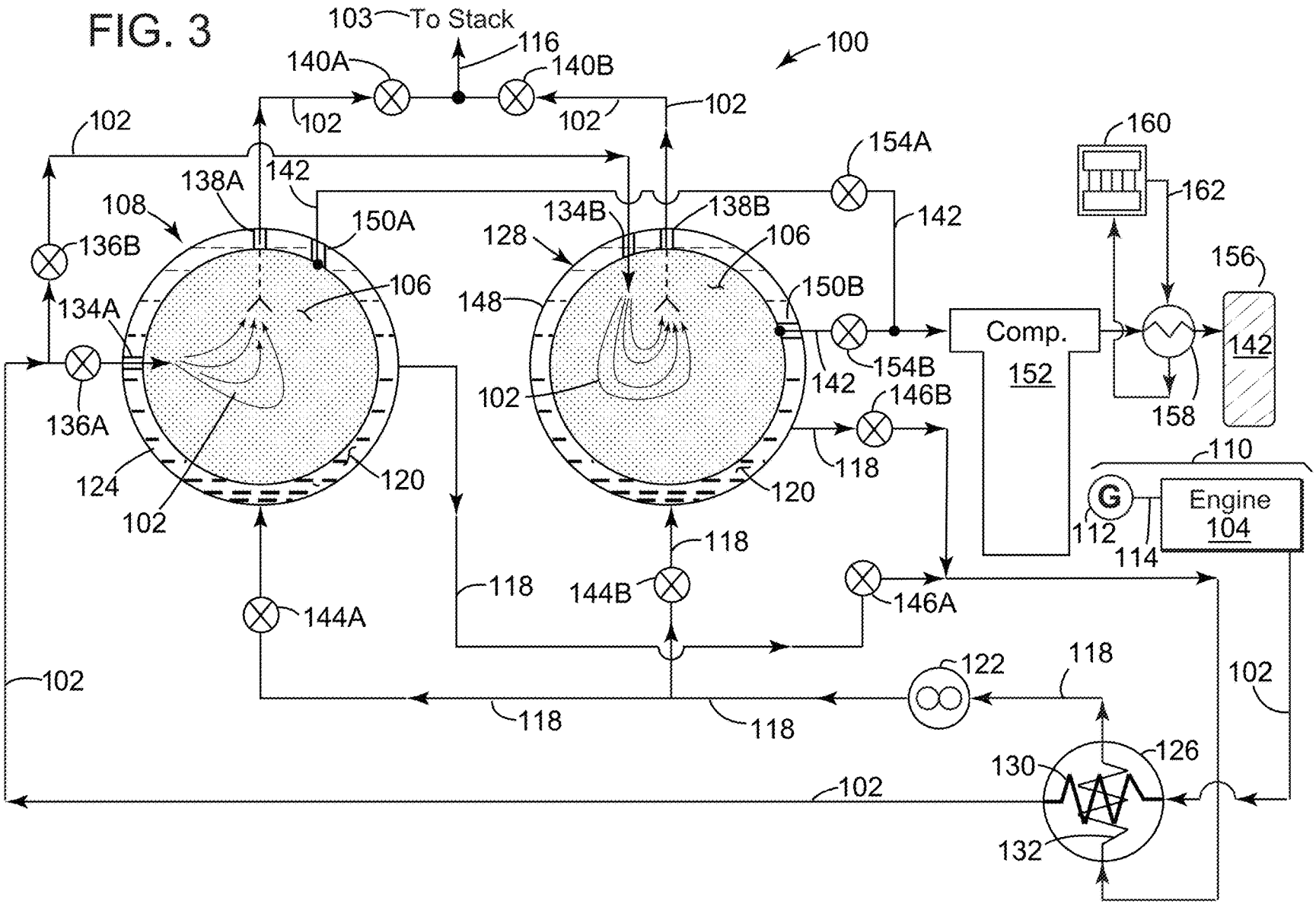

Referring to FIG. 3, another example is depicted of a schematic view of the carbon dioxide capture system 100 of FIG. 1 according to aspects described herein. The carbon dioxide capture system 100 of FIG. 3 has a first capture tank 108 and a second capture tank 128. The carbon dioxide capture system 100 utilizes an exhaust gas to heat exchange fluid heat exchanger 126 to transfer heat from the exhaust gas 102 to a heat exchange fluid 120 in a heat exchange loop 118 that is in heat exchange communication with the first and second capture tanks 108 and 128.

The carbon dioxide capture system 100 of FIG. 3 functions similarly to that of the carbon dioxide capture system 100 of FIG. 2. However, the flow of exhaust gas 102 in FIG. 3 passes through the first flow path 130 of the exhaust gas to heat exchange fluid heat exchanger 126 prior to the flow of exhaust gas 102 passing through the first capture tank 108. This is different from the example of the carbon dioxide capture system 100 illustrated in FIG. 2, wherein the flow of exhaust gas passes through the first capture tank 108 prior to the flow of exhaust gas passing through the first flow path 130 of the exhaust gas to heat exchange fluid heat exchanger 126.

More specifically in FIG. 3, the flow of exhaust gas 102 from engine 104 flows directly into the first flow path 130 of the exhaust gas to heat exchange fluid heat exchanger 126, wherein heat from the exhaust gas 102 is exchanged with the heat exchange fluid 120 of the heat exchange loop 118. Also, when the exhaust gas 102 exits the first flow path 130, it does not then get routed to the stack 103. Rather, the exhaust gas 102 gets routed to the exhaust gas inlet ports 134A and 134B, wherein it enters the first or second capture tanks 108 and 128. The carbon dioxide 142 is then removed by the carbon dioxide absorbent material 106 disposed in the first and second capture tanks 108, 128. The exhaust gas 102 then exits the first and second capture tanks 108, 128 via the exhaust gas outlet ports 138A and 138B, wherein the exhaust gas 102 is then routed to the stack 103.

Advantageously, by routing the flow of exhaust gas first into the first flow path 130 of the heat exchanger 126, there may be more heat energy within the exhaust gas 102 to be transferred to the heat exchange fluid 120 relative to the carbon dioxide capture system 100 of FIG. 2. Accordingly, there may be more heat energy that can be transferred from the heat exchange fluid 120 to the carbon dioxide absorption material 106.

Figure 4:
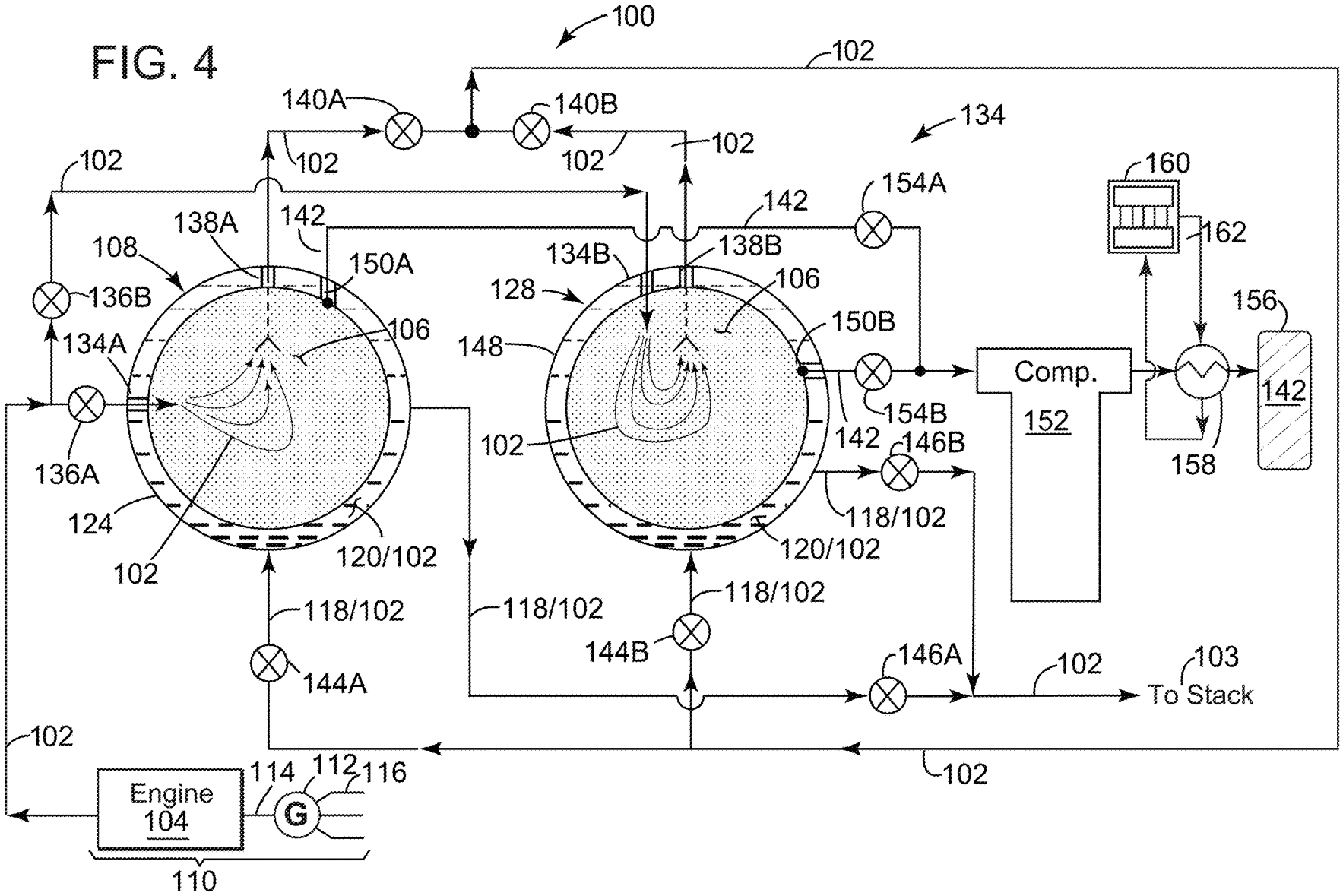
FIG. 4 depicts an example of a schematic view of the carbon dioxide capture system of FIG. 1 having a first and a second capture tank, wherein the exhaust gas is the heat exchange fluid that is circulated in the heat exchange loop, according to aspects described herein.

Referring to FIG. 4, an example is depicted of a schematic view of the carbon dioxide capture system 100 of FIG. 1 having a first capture tank 108 and a second capture tank 128, and wherein the exhaust gas 102 is the heat exchange fluid 120 that is circulated in the heat exchange loop 118, according to aspects described herein.

The carbon dioxide capture system 100 illustrated in FIG. 4 operates similarly to the carbon dioxide capture system of FIG. 2. However, in the carbon dioxide capture system 100 of FIG. 4, the exhaust gas to heat exchange fluid heat exchanger 126 is removed. Accordingly, the heat exchange communication between the flow of exhaust gas 102 and the first and second capture tanks 108, 128 occurs directly, rather than indirectly through the exhaust gas to heat exchange fluid heat exchanger 126. Accordingly, the heat exchange loop 118 is configured to receive the exhaust gas 102 from the engine 104 such that the exhaust gas 102 is the heat exchange fluid 120 that is operable to flow through the heat exchange loop 118.

More specifically, when flow valves 136A, 140A, 144B and 146B are open, and flow valves 136B, 140B, 144A and 146A are closed, the exhaust gas 102 is routed from the engine 104, through inlet port 134A and into the first capture tank 108 to remove the carbon dioxide 142 from the exhaust gas 102. The exhaust gas 102 is then routed from the outlet port 138A directly into the heat exchange loop 118, wherein it functions as the heat exchange fluid 120. That is, the exhaust gas 102 is routed, via the heat exchange loop 118, through the heating jacket 148 of the second capture tank 128 to heat and regenerate the carbon dioxide 142 trapped in the carbon dioxide absorbent material 106 of the second capture tank 128. The exhaust gas 102 is then routed out of the heat exchange loop 118 and up the stack 103.

Additionally, when flow valves 136B, 140B, 144A and 146A are open, and flow valves 136A, 140A, 144B and 146B are closed, the exhaust gas 102 is routed from the engine 104, through inlet port 134B and into the second capture tank 128 to remove the carbon dioxide 142 from the exhaust gas 102. The exhaust gas 102 is then routed from the outlet port 138B directly into the heat exchange loop 118, wherein it functions as the heat exchange fluid 120. That is, the exhaust gas 102 is routed, via the heat exchange loop 118, through the heating jacket 124 of the first capture tank 128 to heat and regenerate the carbon dioxide 142 trapped in the carbon dioxide absorbent material 106 of the first capture tank 128. The exhaust gas 102 is then routed out of the heat exchange loop 118 and up the stack 103.

In the example of the carbon dioxide capture system 100 illustrated in FIG. 4, the flow of exhaust gas 102 passes through the first capture tank 108 prior to the exhaust gas 102 passing through the heat exchange loop 118.

Figure 5:
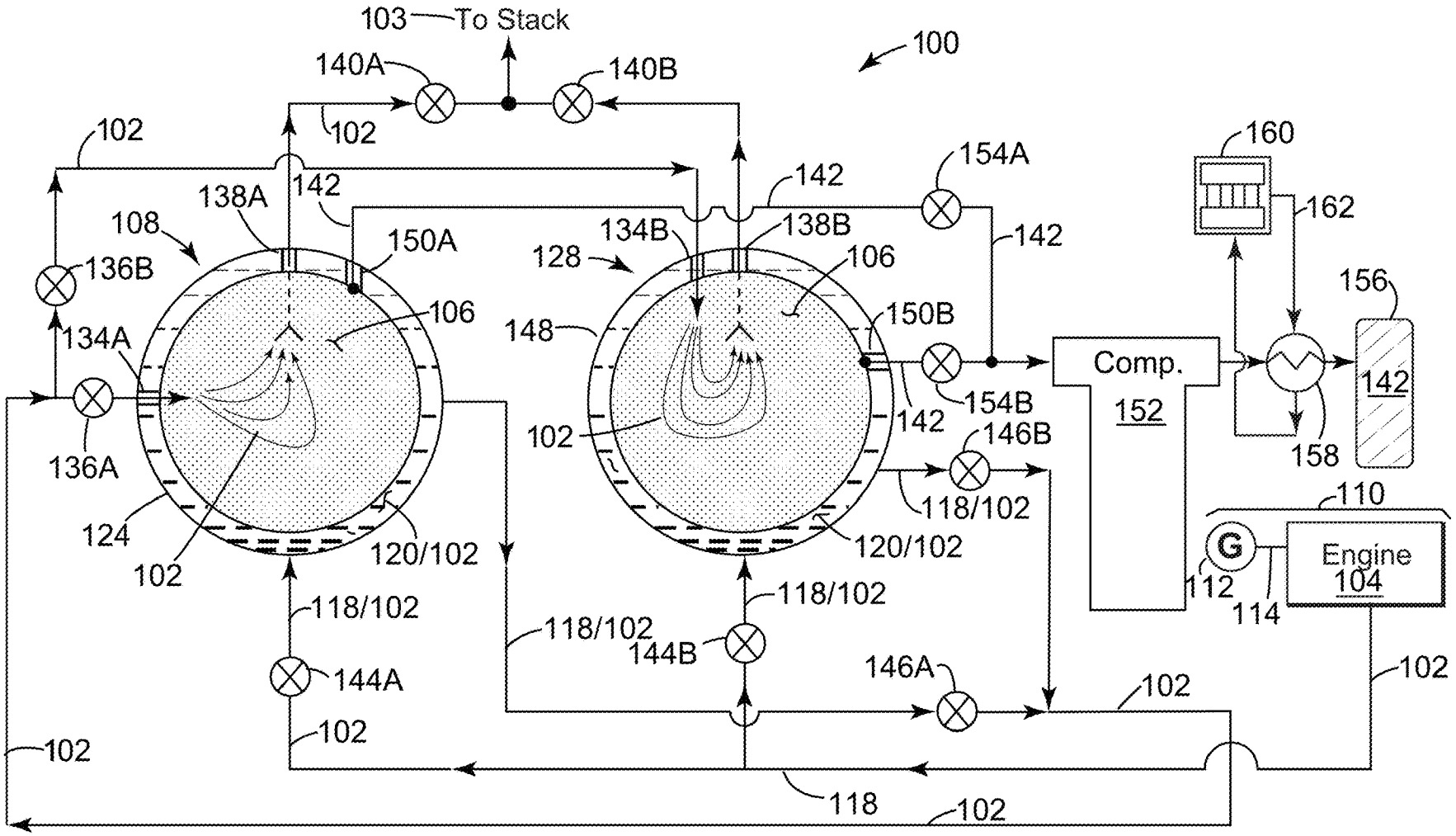
FIG. 5 depicts another example of a schematic view of the carbon dioxide capture system of FIG. 1 having a first and a second capture tank, wherein the exhaust gas is the heat exchange fluid that is circulated in the heat exchange loop, according to aspects described herein.

Referring to FIG. 5, another example is depicted of a schematic view of the carbon dioxide capture system 100 of FIG. 1 having a first and a second capture tank 108, 128, wherein the exhaust gas 102 is the heat exchange fluid 120 that is circulated in the heat exchange loop 118, according to aspects described herein. In this example of the carbon dioxide capture system 100, the flow of exhaust gas 102 passes through the heat exchange loop 118 prior to the exhaust gas 102 passing through the first capture tank 108.

More specifically, when flow valves 136A, 140A, 144B and 146B are open, and flow valves 136B, 140B, 144A and 146A are closed, the exhaust gas 102 is routed from the engine 104, directly into the heat exchange loop 118, wherein it functions as the heat exchange fluid 120. That is, the exhaust gas 102 is routed, via the heat exchange loop 118, through the heating jacket 148 of the second capture tank 128 to heat and regenerate the carbon dioxide 142 trapped in the carbon dioxide absorbent material 106 of the second capture tank 128. The exhaust gas 102 is then routed out of the heat exchange loop 118 and through inlet port 134A and into the first capture tank 108 to remove the carbon dioxide 142 from the exhaust gas 102. The exhaust gas 102 is then routed from the outlet port 138A of the first capture tank 108 and up the stack 103.

Additionally, when flow valves 136B, 140B, 144A and 146A are open, and flow valves 136A, 140A, 144B and 146B are closed, the exhaust gas 102 is routed from the engine 104, directly into the heat exchange loop 118, wherein it functions as the heat exchange fluid 120. That is, the exhaust gas 102 is routed, via the heat exchange loop 118, through the heating jacket 124 of the first capture tank 108 to heat and regenerate the carbon dioxide 142 trapped in the carbon dioxide absorbent material 106 of the first capture tank 108. The exhaust gas 102 is then routed out of the heat exchange loop 118 and through inlet port 134B and into the second capture tank 128 to remove the carbon dioxide 142 from the exhaust gas 102. The exhaust gas 102 is then routed from the outlet port 138B of the second capture tank 128 and up the stack 103.

Referring to FIG. 6, an example is depicted of a schematic view of at least a portion of carbon dioxide capture system 100 having a first capture tank 108 with carbon dioxide absorbent material 106 disposed therein, according to aspects described herein. The carbon dioxide capture system 100 is removing carbon dioxide 142 from the flow of exhaust gas 102 that is passing through the first capture tank 108 and further utilizing heat from engine coolant 164 from the engine 104 to regenerate the carbon dioxide 142.

The carbon dioxide capture system 100 as illustrated in FIG. 6 functions similarly to the carbon dioxide capture system 100 as illustrated in FIG. 1. However, rather than using the exhaust gas 102 as a heat source to regenerate the carbon dioxide 142 trapped in the carbon dioxide absorbent material 106, the system 100 of FIG. 6 utilizes a flow of engine coolant 164 from the engine 104 as the heat source.

The carbon dioxide capture system 100 of FIG. 6 includes a first capture tank 108 containing carbon dioxide absorbent material 106 which operates to absorb carbon dioxide 142 from a flow of exhaust gas 102 from an internal combustion engine 104. A heat exchange loop 118 is in heat exchange communication with the first capture tank 108 and further in heat exchange communication with a flow of engine coolant 164 from the internal combustion engine 104. A heat exchange fluid 120, such as glycol, water of the like, is operable to flow through the heat exchange loop 118. The heat exchange fluid 120 operates to transfer heat from the engine coolant 164 to the first capture tank 108. The heat from the engine coolant 164 operates to release a portion of the carbon dioxide 142 absorbed by the carbon dioxide absorbent material 106 in the first capture tank 108.

The system 100 also includes an "engine coolant to heat exchange fluid heat exchanger" 168. The engine coolant to heat exchange fluid heat exchanger 168 includes a first flow path 170 and a second flow path 172 which operate to exchange heat therebetween. The first flow path 170 operates to receive therethrough the flow of engine coolant 164 from the engine 104. The second flow path 172 operates to receive therethrough the flow of heat exchange fluid 120 in the heat exchange loop 118. The engine coolant to heat exchange fluid heat exchanger 168 operates to transfer heat from the engine coolant 164 to the heat exchange fluid 120. The heat exchange loop 118 operates to flow the heat exchange fluid 120 to the first capture tank 108 and to transfer heat from the heat exchange fluid 120 to the carbon dioxide absorbent material 106 in the first capture tank 108.

More specifically, the flow of exhaust gas 102 to the first capture tank 108 is controlled by a flow valve 136A. When the flow valve 136A is open, the exhaust gas 102 enters the first capture tank 108 through an exhaust gas inlet port 134A of the first capture tank 108. Carbon dioxide 142 is then removed from the exhaust gas 102 upon contact with the carbon dioxide absorbent material 106 disposed within the first capture tank 108. The flow of exhaust gas then exits the first capture tank 108 through an exhaust gas outlet port 138A of the first capture tank 108 and routed up the stack 103 of the engine 104.

The flow of engine coolant 164 is routed from the engine 104 to the first flow path 170 of the engine coolant to heat exchange fluid heat exchanger 168 via engine coolant pump 166. The engine coolant 164 then flows through the first flow path 170 and back to the engine 104.

The flow of heat exchange fluid 120 in the heat exchange loop 118 is controlled by flow valves 144A and 146A and by heat exchange fluid pump 122. When the flow valves 144A, 146A are open, the heat exchange fluid pump 122 routes the flow of heat exchange fluid 120 from the second flow path 172 of heat exchanger 168 and through the heating jacket 124 of the first capture tank 108. The heat exchange fluid 120 in the heating jacket 124 then transfers heat picked up from the engine coolant 164 into the carbon dioxide absorbent material 106. The heated absorbent material 106 then releases (or regenerates) the carbon dioxide 142 trapped within. The carbon dioxide 142 may be routed out of the carbon dioxide outlet port 150A of the first capture tank 108.

The carbon dioxide absorbent materials 106 may be composed of carbon dioxide adsorbent materials such as zeolite or similar. As such, the adsorbent materials may release their adsorbed carbon dioxide at fairly low temperatures, such as 220 degrees F. or less. This may be advantageous when utilizing heat from the engine coolant 164 of the internal combustion engine 104 to regenerate the carbon dioxide 142, since the engine coolant 164 may have an operating temperature that is about 230 degrees F. or lower.

Referring to FIG. 7, an example is depicted of a schematic view of the carbon dioxide capture system 100 of FIG. 6 having a first capture tank 108 and a second capture tank 128 according to aspects described herein. The carbon dioxide capture system 100 illustrated in FIG. 7 functions similarly to the carbon dioxide capture system of FIG. 2. However, instead of utilizing an exhaust gas to heat exchange fluid heat exchanger 126 to transfer heat from the exhaust gas 102 to the heat exchange fluid 120 in the heat exchange loop 118, the system illustrated in FIG. 7 utilizes an engine coolant to heat exchange fluid heat exchanger 168 to transfer heat from the engine coolant 164 to the heat exchange fluid 120.

During operation, the various flow valves 136A, 136B, 140A, 140B, 144A, 144B, 146A, 146B, 154A and 154B may be configured such that the exhaust gas inlet port 134A of the first capture tank 108 is connected (i.e., in fluid communication) to the flow of exhaust gas 102 from the engine 104. Additionally, the first capture tank's exhaust gas outlet port 138A is connected (i.e., in fluid communication) to the stack 103 of the engine 104. Additionally, the carbon dioxide compressor 152 may be connected to the carbon dioxide outlet port 150B of the second capture tank 128. The heat exchange loop 118 may be connected between the engine coolant to heat exchange fluid heat exchanger 168 and the second capture tank 128. In this configuration, exhaust gas 102 will flow into the first capture tank 108 to remove the carbon dioxide 142 from the exhaust gas 102 flow. The exhaust gas 102 will then be routed out of the outlet port 138A of the first capture tank 108 and up the stack 103. The engine coolant will be pumped via engine coolant pump 166 to engine coolant to heat exchange fluid heat exchanger 168. The heat exchanger 168 will transfer heat from the engine coolant 164 into the heat exchange fluid 120, which will be pumped via pump 122 through the heat exchange loop 118 to the heating jacket 148 of the second capture tank 128. Accordingly, the heat from the engine coolant 164 will advantageously be used to heat the second capture tank 128 to regenerate the carbon dioxide from the second capture tank 128 and to pump the carbon dioxide 142 into the holding tank 156. By using the heat from the engine coolant 164 to regenerate the carbon dioxide in the second capture tank 128, the energy needed from external sources (such as electric heaters or the like) to regenerate the carbon dioxide 142 is advantageously reduced.

Also during operation, the various flow valves 136A, 136B, 140A, 140B, 144A, 144B, 146A, 146B, 154A and 154B may be configured such that the exhaust gas inlet port 134B of the second capture tank 128 is connected (i.e., in fluid communication) to the flow of exhaust gas 102 from the engine 104. Additionally, the second capture tank's exhaust gas outlet port 138B is connected (i.e., in fluid communication) to the stack 103 of the engine 104. Additionally, the carbon dioxide compressor 152 may be connected to the carbon dioxide outlet port 150A of the first capture tank 108. The heat exchange loop 118 may be connected between the engine coolant to heat exchange fluid heat exchanger 168 and the first capture tank 108. In this configuration, exhaust gas 102 will flow into the second capture tank 128 to remove the carbon dioxide 142 from the exhaust gas 102 flow. The exhaust gas 102 will then be routed out of the outlet port 138B of the first capture tank 108 and up the stack 103. The engine coolant will be pumped via engine coolant pump 166 to the engine coolant to heat exchange fluid heat exchanger 168. The heat exchanger 168 will transfer heat from the engine coolant 164 into the heat exchange fluid 120, which will be pumped via pump 122 through the heat exchange loop 118 to the heating jacket 124 of the first capture tank 108. Accordingly, the heat from the engine coolant 164 will advantageously be used to heat the first capture tank 108 to regenerate the carbon dioxide from the first capture tank 108 and to pump the carbon dioxide 142 into the holding tank 156. By using the heat from the engine coolant 164 to regenerate the carbon dioxide in the first capture tank 108, the energy needed from external sources (such as electric heaters or the like) to regenerate the carbon dioxide 142 is advantageously reduced.

Referring to FIG. 8, another example is depicted of a schematic view of the carbon dioxide capture system 100 of FIG. 6 having a first and a second capture tank 108, 128, wherein the engine coolant 164 is the heat exchange fluid 120 that is circulated in the heat exchange loop 118, according to aspects described herein.

The carbon dioxide capture system 100 illustrated in FIG. 8 operates similarly to the carbon dioxide capture system of FIG. 7. However, in the carbon dioxide capture system 100 of FIG. 8, the engine coolant to heat exchange fluid heat exchanger 168 is removed. Accordingly, the heat exchange communication between the flow of engine coolant 164 and the first and second capture tanks 108, 128 occurs directly, rather than indirectly through the engine coolant to heat exchange fluid heat exchanger 168. Accordingly, the heat exchange loop 118 is configured to receive the engine coolant 164 from the engine 104 such that the engine coolant 164 is the heat exchange fluid 120 that is operable to flow through the heat exchange loop 118.

More specifically, when flow valves 136A, 140A, 144B and 146B are open, and flow valves 136B, 140B, 144A and 146A are closed, the exhaust gas 102 is routed from the engine 104, through inlet port 134A and into the first capture tank 108 to remove the carbon dioxide 142 from the exhaust gas 102. The exhaust gas 102 is then routed from the outlet port 138A to the stack 103. The engine coolant is routed via pump 166 directly into the heat exchange loop 118, wherein it functions as the heat exchange fluid 120. That is, the engine coolant 164 is routed, via the heat exchange loop 118, through the heating jacket 148 of the second capture tank 128 to heat and regenerate the carbon dioxide 142 trapped in the carbon dioxide absorbent material 106 of the second capture tank 128.

Additionally, when flow valves 136B, 140B, 144A and 146A are open, and flow valves 136A, 140A, 144B and 146B are closed, the exhaust gas 102 is routed from the engine 104, through inlet port 134B and into the second capture tank 128 to remove the carbon dioxide 142 from the exhaust gas 102. The exhaust gas 102 is then routed from the outlet port 138B to the stack 103. The engine coolant 164 is routed via pump 166 directly into the heat exchange loop 118, wherein it functions as the heat exchange fluid 120. That is, the engine coolant 164 is routed, via the heat exchange loop 118, through the heating jacket 124 of the first capture tank 108 to heat and regenerate the carbon dioxide 142 trapped in the carbon dioxide absorbent material 106 of the first capture tank 108.

Referring to FIG. 9, an example is depicted of a schematic view of the carbon dioxide capture system 100 of FIG. 1, which includes a turbine-generator system 174, which may be utilized to supply power to the carbon dioxide capture system 100, in accordance with aspects described herein. The turbine-generator system 174 is a form of bottoming cycle power system, that can be used to supply a portion of, or all, electrical power requirements of the carbon dioxide capture system 100. Such bottoming system power systems are described in patent application Ser. No. 17/448,943, filed on Sep. 27, 2021, titled: SYSTEMS AND METHODS ASSOCIATED WITH BOTTOMING CYCLE POWER SYSTEMS FOR GENERATING POWER AND CAPTURING CARBON DIOXIDE, and in issued U.S. Pat. No. 11,346,256, filed on Sep. 27, 2021, titled: SYSTEMS AND METHODS ASSOCIATED WITH BOTTOMING CYCLE POWER SYSTEMS FOR GENERATING POWER, CAPTURING CARBON DIOXIDE AND PRODUCING PRODUCTS, both of which are incorporated herein by reference in their entirety.

The turbine-generator system 174 includes a turbo-expander and turbo-compressor 178 disposed on a turbo-crankshaft 180. The turbo-expander 176 operates to rotate the turbo-crankshaft 180 as the flow of exhaust gas 102 from the engine 104 passes through the turbo-expander 176. The turbo-compressor 178 operates to compress the flow of exhaust gas 102 after the exhaust gas 102 passes through the turbo-expander 176. A bottoming cycle generator 182 may be disposed on the turbo-crankshaft 180. The bottoming cycle generator 182 may be connected to the carbon dioxide capture system 100. The bottoming cycle generator 182 may operate to provide at least a portion of electric power required to operate the carbon dioxide capture system 100.

As illustrated in FIG. 9, the flow of exhaust gas 102 may pass through the turbo-expander 176 and the turbo-compressor 178 prior to the flow of exhaust gas 102 passing through the first capture tank 108. Alternatively however, the flow of exhaust gas 102 may pass through the first capture tank 108 prior to the flow of exhaust gas 102 passing through turbo-expander 176 and the turbo-compressor 178.

Advantageously, by supplying some or all of the electric power requirements of the carbon dioxide capture system 100 with the turbine-generator system 174, the detrimental effects on the efficiency of the primary power system 110 are significantly reduced.

Referring to FIG. 10, an example is depicted of a schematic view of the carbon dioxide capture system 100 of FIG. 6, which includes a turbine-generator system 174, which is utilized to supply power to the carbon dioxide capture system 100, in accordance with aspects described herein.

The turbine-generator system 174 includes a turbo-expander and turbo-compressor 178 disposed on a turbo-crankshaft 180. The turbo-expander 176 operates to rotate the turbo-crankshaft 180 as the flow of exhaust gas 102 from the engine 104 passes through the turbo-expander 176. The turbo-compressor 178 operates to compress the flow of exhaust gas 102 after the exhaust gas 102 passes through the turbo-expander 176. A bottoming cycle generator 182 may be disposed on the turbo-crankshaft 180. The bottoming cycle generator 182 may be connected to the carbon dioxide capture system 100. The bottoming cycle generator 182 may operate to advantageously provide at least a portion of electric power required to operate the carbon dioxide capture system 100. However, the turbine-generator system 174 of FIG. 10 may also include an exhaust gas to exhaust gas heat exchanger 184 and an exhaust gas processing system 190 to help enhance the output of the bottoming cycle generator 182.

The exhaust gas to exhaust gas heat exchanger 184 includes a first flow path 186 and a second flow path 188 which operate to exchange heat therebetween. The first flow path 186 operates to receive the flow of exhaust gas 102 from the turbo-expander 176 prior to the exhaust gas 102 being compressed by the turbo-compressor 178. At this stage, the flow of exhaust gas 102 is hot (e.g., 850 to 950 degrees F.). The second flow path 188 operates to receive the flow of exhaust gas 102 from the turbo-compressor 178 after the exhaust gas 102 has been compressed by the turbo-compressor 178. More specifically, the second flow path 188 would receive the flow of exhaust gas 102 after it has passed through the turbo-compressor 178, then entered the carbon dioxide capture system 100 to have its carbon dioxide 142 removed, and then has exited output port 138A to be routed into the second flow path 188 of the heat exchanger 184. At this stage, the exhaust gas has cooled substantially (e.g., 200-100 degrees F.). Accordingly, the much cooler exhaust gas in the second flow path 188 will help to cool the hotter exhaust gas 102 in the first flow path 186. By cooling the exhaust gas 102 prior to entering the turbo-compressor 178, the exhaust gas is made denser and the work needed to compress the denser exhaust gas 102 is reduced. Accordingly, the efficiency of the turbine-generator system 174 is increased and more power can be produced by the bottoming cycle generator 182.

The exhaust gas processing system 190 may also be used to further cool and/or remove water from the exhaust gas 102 prior to the exhaust gas 102 entering the turbo-compressor 178. This will also tend to reduce the work needed by the turbo-compressor 178 to compress the exhaust gas 102 and, therefore, further increase the efficiency of the turbine-generator system 174.

The exhaust gas processing system 190 may be configured to receive and cool and/or dry the flow of exhaust gas 102 after the exhaust gas 102 has passed through turbo-expander 176 and prior to the exhaust gas 102 being compressed by the turbo-compressor 178. In the example illustrated in FIG. 10, the exhaust gas processing system 190 receives the flow of exhaust gas 102 after it has passed through the turbo-expander 176 and the exhaust gas to exhaust gas heat exchanger 184. The exhaust gas processing system 190 may include, for example, at least one of a cooling tower, a cooling tower heat exchanger, an absorption chiller, an absorption chiller heat exchanger, a dehumidifier system, a vapor-compression refrigeration system or the like.

Referring to FIG. 11, another example is depicted of a schematic view of the carbon dioxide capture system 100 of FIG. 1, which includes a turbine-generator system 174, which may be utilized to supply power to the carbon dioxide capture system 100, in accordance with aspects described herein. The system 100 illustrate in FIG. 11 functions similarly to the system 100 illustrated in FIG. 9. However, in FIG. 11, the exhaust gas 102 is routed from the turbo-expander 176 to the first flow path 130 of the exhaust gas to heat exchange fluid heat exchanger 126 prior to entering the turbo-compressor 178. Upon exiting the turbo-compressor, the exhaust gas is the routed into the first capture tank 108 to have its carbon dioxide 142 removed.

In the configuration of FIG. 11, the carbon dioxide capture system 100 functions as a type of exhaust gas processing system (such as the exhaust gas processing system 190 of FIG. 10). More specifically, the carbon dioxide capture system 100 in FIG. 11 is used to cool the exhaust gas 102 prior to entering the turbo-compressor, which increases the density of the exhaust gas and reduces the amount of work required by the turbo-compressor 178 to compress the exhaust gas 102. Accordingly, the efficiency of the turbine-generator system 174 is increased and the power output of the bottoming cycle generator 182 is also increased.

Referring to FIG. 12, an example is depicted of a flow diagram of a method 200 of capturing carbon dioxide 142 from a flow of exhaust gas 102 from an internal combustion engine 104, in accordance with aspects described herein. The method may utilize one or more of the examples of the carbon dioxide capture systems 100 describe herein.

The method 200 (FIG. 12), as well each following method 220 (FIG. 13), method 240 (FIG. 14), method 250 (FIG. 15), method 260 (FIG. 16), method 280 (FIG. 17), method 300 (FIG. 18), method 320 (FIG. 19) and method 330 (FIG. 20) depicts non-limiting examples of various steps of carrying out the methods. However, the order in which the steps of each method are executed may not coincide with the order in which the steps are illustrated in each of FIGS. 12 through 20. Additionally, certain other unillustrated steps may be added to the illustrated methods.

At 202, the method includes routing a flow of exhaust gas 102 from an internal combustion engine 104 into a first capture tank 108 of a carbon dioxide capture system; 100.

At 204, carbon dioxide 142 is absorbed from the exhaust gas 102 in the first capture tank 108 with carbon dioxide absorbent material 106 that is disposed (or positioned) in the first capture tank 108.

At 206, the flow of exhaust gas is routed out of the first capture tank.

At 208, a heat exchange loop 118 is connected in heat exchange communication with the first capture tank 108. Additionally, the heat exchange loop 118 is connected in heat exchange communication with one of the flow of exhaust gas 102 or a flow of engine coolant 164 from the internal combustion engine 104.

At 210, a heat exchange fluid 120 is circulated through the heat exchange loop 118.

At 212, heat is transferred from the exhaust gas 102 or the engine coolant 164 to the first capture tank 108 via the heat exchange fluid 120.

At 214, a portion of the carbon dioxide 142 absorbed by the carbon dioxide absorbent material 106 in the first capture tank 108 is released, as a result of the heat transferred from the exhaust gas 102 or the engine coolant 164.

Referring to FIG. 13, another example is depicted of a flow diagram of a method 220 of capturing carbon dioxide 142 from a flow of exhaust gas 102 from an internal combustion engine 104, in accordance with aspects described herein. The flow diagram of the method 220 is a continuation of the flow diagram of the method 200 of FIG. 12.

At 222, the method includes routing the flow of exhaust gas 102 through a first flow path 130 of an exhaust gas to heat exchange fluid heat exchanger 126.

At 224, The heat exchange fluid 120 is routed through a second flow path 132 of the exhaust gas to heat exchange fluid heat exchanger 126.

At 226, Heat is transferred from the exhaust gas 102 to the heat exchange fluid 120 via the exhaust gas to heat exchange fluid heat exchanger 126.

At 228, The heat exchange fluid 120 is flowed to the first capture tank 108.

At 230, Heat is transferred from the heat exchange fluid 120 to the carbon dioxide absorbent material 106 in the first capture tank 108.

Referring to FIG. 14, another example is depicted of a flow diagram of a method 240 of capturing carbon dioxide 142 from a flow of exhaust gas 102 from an internal combustion engine 104, in accordance with aspects described herein. The flow diagram of the method 240 is a continuation of the flow diagram of the method 200 of FIG. 12.

At 242, the method incudes receiving the exhaust gas 102 from the engine 104 into the heat exchange loop 118, such that the exhaust gas 102 is the heat exchange fluid 120 that flows through the heat exchange loop 118. In other words, in this method 240, the exhaust gas to heat exchange fluid heat exchanger 126 is not utilized. Therefore, the exhaust gas 102 flows into the heat exchange loop 118 to heat the first capture tank 108 directly, rather than heating the first capture tank 108 indirectly through an exhaust gas to heat exchange fluid heat exchanger 126.

Referring to FIG. 15, another example is depicted of a flow diagram of a method 250 of capturing carbon dioxide 142 from a flow of exhaust gas 102 from an internal combustion engine 104, in accordance with aspects described herein. The flow diagram of the method 250 is a continuation of the flow diagram of the method 200 of FIG. 12.

At 252, the method incudes receiving the engine coolant 164 from the engine 104 into the heat exchange loop 118, such that the engine coolant 164 is the heat exchange fluid 120 that flows through the heat exchange loop 118. In other words, in this method 250, the engine coolant to heat exchange fluid heat exchanger 168 is not utilized. Therefore, the engine coolant 164 flows into the heat exchange loop 118 to heat the first capture tank 108 directly, rather than heating the first capture tank 108 indirectly through an engine coolant to heat exchange fluid heat exchanger 168.

Referring to FIG. 16, another example is depicted of a flow diagram of a method 260 of capturing carbon dioxide 142 from a flow of exhaust gas 102 from an internal combustion engine 104, in accordance with aspects described herein. The flow diagram of the method 260 is a continuation of the flow diagram of the method 200 of FIG. 12.

At 262, the method includes routing the flow of engine coolant 164 through a first flow path 170 of an engine coolant to heat exchange fluid heat exchanger 168.

At 264, the heat exchange fluid 120 is routed through a second flow path 172 of the engine coolant to heat exchange fluid heat exchanger 168.

At 266, heat is transferred from the engine coolant 164 to the heat exchange fluid 120 via the engine coolant to heat exchange fluid heat exchanger 168.

At 268, the heat exchange fluid 120 is flowed to the first capture tank 108.

At 270, heat is transferred from the heat exchange fluid 120 to the absorbent material 106 in the first capture tank 108. Referring to FIG. 17, another example is depicted of a flow diagram of a method 280 of capturing carbon dioxide 142 from a flow of exhaust gas 102 from an internal combustion engine 104, in accordance with aspects described herein. The flow diagram of the method 280 is a continuation of the flow diagram of the method 200 of FIG. 12.

At 282, the method includes routing the flow of exhaust gas 102 through a turbo-expander 176 disposed on a turbo-crankshaft 180 of a turbine-generator system 174.

At 284, the flow of exhaust gas 102 is compressed via a turbo-compressor 178 disposed on the turbo-crankshaft 180 of the turbine-generator system 174 after the exhaust gas 102 passes through the turbo-expander 176.

At 286, electric power is generated via a bottoming cycle generator 182 disposed on the turbo-crankshaft 180 of the turbine-generator system 174.

At 288, at least a portion of electric power required to operate the carbon dioxide capture system 100 is provided from the electric power generated by the bottoming cycle generator 182.

Referring to FIG. 18, another example is depicted of a flow diagram of a method 300 of capturing carbon dioxide 142 from a flow of exhaust gas 102 from an internal combustion engine 104, in accordance with aspects described herein. The flow diagram of the method 300 is a continuation of the flow diagram of the method 200 of FIG. 12.

At 302, the method includes routing the flow of exhaust gas 102 into a second capture tank 128 of the carbon dioxide capture system 100.

At 304, carbon dioxide 142 is absorbed in the second capture tank 128 from the exhaust gas 102 with carbon dioxide absorbent material 106 disposed in the second capture tank 128.

At 306, the flow of exhaust gas 102 is routed out of the second capture tank 128.

At 308, the heat exchange loop 118 is connected in heat exchange communication with either the first capture tank 108 or the second capture tank 128. Additionally the heat exchange loop 118 is connected in heat exchange communication with one of the flow of exhaust gas 102 or a flow of engine coolant 164 from the internal combustion engine 104.

At 310, the heat exchange fluid is circulated through the heat exchange loop 118.

At 312, heat is transferred from the exhaust gas 102 or the engine coolant 164 to either the first capture tank 108 or the second capture tank 128 via the heat exchange fluid 120.

At 314, a portion of the carbon dioxide 142 absorbed by the carbon dioxide absorbent material 106 in either the first capture tank 108 or the second capture tank 128 is released, as a result of the heat transferred from the exhaust gas 102 or the engine coolant 164.

Referring to FIG. 19, another example is depicted of a flow diagram of a method 320 of capturing carbon dioxide 142 from a flow of exhaust gas 102 from an internal combustion engine 104, in accordance with aspects described herein. The flow diagram of the method 320 is a continuation of the flow diagram of the method 300 of FIG. 18.

At 322, the method includes connecting the heat exchange loop 118 in heat exchange communication with the second capture tank 128 and further connecting the heat exchange loop 118 in heat exchange communication with one of the flow of exhaust gas 102 or a flow of engine coolant 164 when the flow of exhaust gas 102 is routed into the first capture tank 108. In this configuration, the exhaust gas 102 or engine coolant 164 will heat the second capture tank 128 to regenerate the carbon dioxide 142 trapped within, while the carbon dioxide 142 from the exhaust gas 102 will be absorbed in the first capture tank 108.

At 324, the heat exchange loop 118 is connected in heat exchange communication with the first capture tank 108 and the heat exchange loop 118 is further connected in heat exchange communication with one of the flow of exhaust gas 102 or a flow of engine coolant 164 when the flow of exhaust gas 102 is routed into the second capture tank 128. In this configuration, the exhaust gas 102 or engine coolant 164 will heat the first capture tank 108 to regenerate the carbon dioxide 142 trapped within, while the carbon dioxide 142 from the exhaust gas 102 will be absorbed in the second capture tank 128.

Referring to FIG. 20, another example is depicted of a flow diagram of a method 330 of capturing carbon dioxide 142 from a flow of exhaust gas 102 from an internal combustion engine 104, in accordance with aspects described herein. The flow diagram of the method 330 is a continuation of the flow diagram of the method 220 of FIG. 13.

At 332, the method includes routing the flow of exhaust gas 102 through a turbo-expander 176 of a turbine-generator system 174, then through the first flow path 130 of the exhaust gas to heat exchange fluid heat exchanger 126, then through a turbo-compressor 178 of the turbine-generator system 174, then through the first capture tank 108.

This method is associated with the carbon dioxide capture system 100 of FIG. 11. In the system 100 of FIG. 11, the exhaust gas 102 is routed from the turbo-expander 176 to the first flow path 130 of the exhaust gas to heat exchange fluid heat exchanger 126 prior to entering the turbo-compressor 178. Upon exiting the turbo-compressor, the exhaust gas is the routed into the first capture tank 108 to have its carbon dioxide 142 removed.

In the configuration of FIG. 11, the carbon dioxide capture system 100 functions as a type of exhaust gas processing system (such as the exhaust gas processing system 190 of FIG. 10). More specifically, the carbon dioxide capture system 100 in FIG. 11 is used to cool the exhaust gas 102 prior to entering the turbo-compressor, which increases the density of the exhaust gas and reduces the amount of work required by the turbo-compressor 178 to compress the exhaust gas 102. Accordingly, the efficiency of the turbine-generator system 174 is increased and the power output of the bottoming cycle generator 182 is also increased.

It should be appreciated that all combinations of the foregoing concepts and additional concepts discussed in greater detail herein (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

Although the invention has been described by reference to specific examples, it should be understood that numerous changes may be made within the spirit and scope of the inventive concepts described. Accordingly, it is intended that the disclosure not be limited to the described examples, but that it have the full scope defined by the language of the following claims.

What is claimed is:

1. A carbon dioxide capture system comprising:

a first capture tank containing carbon dioxide absorbent material which operates to absorb carbon dioxide from a flow of exhaust gas from an internal combustion engine;

a heat exchange loop in heat exchange communication with the first capture tank and further in heat exchange communication with one of the flow of exhaust gas or a flow of engine coolant from the internal combustion engine; and a heat exchange fluid operable to flow through the heat exchange loop;

wherein, the heat exchange fluid operates to transfer heat from the exhaust gas or the engine coolant to the first capture tank while the engine is running, wherein the heat from the exhaust gas or the engine coolant operates to release a portion of the carbon dioxide absorbed by the carbon dioxide absorbent material in the first capture tank.

2. The carbon dioxide capture system of claim 1, comprising:

an exhaust gas to heat exchange fluid heat exchanger comprising a first flow path and a second flow path which operate to exchange heat therebetween, wherein:

the first flow path operates to receive therethrough the flow of exhaust gas from the engine, and the second flow path operates to receive therethrough the flow of heat exchange fluid in the heat exchange loop;

wherein the exhaust gas to heat exchange fluid heat exchanger operates to transfer heat from the exhaust gas to the heat exchange fluid; and and wherein the heat exchange loop operates to flow the heat exchange fluid to the first capture tank and to transfer heat from the heat exchange fluid to the absorbent material in the first capture tank.

3. The carbon dioxide capture system of claim 2, wherein the flow of exhaust gas passes through the first capture tank prior to the flow of exhaust gas passing through the first flow path of the exhaust gas to heat exchange fluid heat exchanger.

4. The carbon dioxide capture system of claim 2, wherein the flow of exhaust gas passes through the first flow path of the exhaust gas to heat exchange fluid heat exchanger prior to the flow of exhaust gas passing the first capture tank.

5. The carbon dioxide capture system of claim 2, comprising:

a turbine-generator system comprising a turbo-expander and turbo-compressor disposed on a turbo-crankshaft, wherein:

the turbo-expander operates to rotate the turbo-crankshaft as the flow of exhaust gas passes through the turbo-expander, and the turbo-compressor operates to compress the flow of exhaust gas after the exhaust gas passes through the turbo-expander; and wherein the flow of exhaust gas is routed through the turbo-expander, then through the first flow path of the exhaust gas to heat exchange fluid heat exchanger, then through the turbo-compressor, then through the first capture tank.

6. The carbon dioxide capture system of claim 1, comprising:

the heat exchange loop being configured to receive the exhaust gas from the engine such that the exhaust gas is the heat exchange fluid that is operable to flow through the heat exchange loop.

7. The carbon dioxide capture system of claim 6, wherein the flow of exhaust gas passes through the first capture tank prior to the exhaust gas passing through the heat exchange loop.

8. The carbon dioxide system of claim 6, wherein the flow of exhaust gas passes through the heat exchange loop prior to the exhaust gas passing through the first capture tank.

9. The carbon dioxide capture system of claim 1, comprising:

an engine coolant to heat exchange fluid heat exchanger comprising a first flow path and a second flow path which operate to exchange heat therebetween, wherein:

the first flow path operates to receive therethrough the flow of engine coolant from the engine, and the second flow path operates to receive therethrough the flow of heat exchange fluid in the heat exchange loop;

wherein the engine coolant to heat exchange fluid heat exchanger operates to transfer heat from the engine coolant to the heat exchange fluid; and and wherein the heat exchange loop operates to flow the heat exchange fluid to the first capture tank and to transfer heat from the heat exchange fluid to the absorbent material in the first capture tank.

10. The carbon dioxide capture system of claim 1, comprising:

the heat exchange loop being configured to receive the engine coolant from the engine such that the engine coolant is the heat exchange fluid that is operable to flow through the heat exchange loop.

11. The carbon dioxide capture system of claim 1, comprising:

a turbine-generator system comprising a turbo-expander and turbo-compressor disposed on a turbo-crankshaft, wherein:

the turbo-expander operates to rotate the turbo-crankshaft as the flow of exhaust gas passes through the turbo-expander, and the turbo-compressor operates to compress the flow of exhaust gas after the exhaust gas passes through the turbo-expander.

12. The carbon dioxide capture system of claim 11, wherein the turbine-generator system comprises:

a bottoming cycle generator disposed on the turbo-crankshaft, the bottoming cycle generator connected to the carbon dioxide capture system, the bottoming cycle generator operates to provide at least a portion of electric power required to operate the carbon dioxide capture system.

13. The carbon dioxide capture system of claim 11, wherein the flow of exhaust gas passes through the turbo-expander and the turbo-compressor prior to the flow of exhaust gas passing through the first capture tank.

14. The carbon dioxide capture system of claim 11, wherein the flow of exhaust gas passes through the first capture tank prior to the flow of exhaust gas passing through turbo-expander and the turbo-compressor.

15. The carbon dioxide capture system of claim 11, comprising:

an exhaust gas processing system to receive and cool the flow of exhaust gas after the exhaust gas has passed through turbo-expander and prior to the exhaust gas being compressed by the turbo-compressor, wherein:

the exhaust gas processing system comprises at least one of a cooling tower, a cooling tower heat exchanger, an absorption chiller, an absorption chiller heat exchanger, a dehumidifier system and a vapor-compression refrigeration system.

16. The carbon dioxide capture system of claim 11, comprising:

an exhaust gas to exhaust gas heat exchanger comprising a first flow path and a second flow path which operate to exchange heat therebetween, wherein:

the first flow path operates to receive the flow of exhaust gas from the turbo-expander prior to the exhaust gas being compressed by the turbo-compressor, and the second flow path operates to receive the flow of exhaust gas from the turbo-compressor after the exhaust gas has been compressed by the turbo-compressor.

17. The carbon dioxide capture system of claim 1, comprising:

the first capture tank comprising:

an exhaust gas inlet port connected to the flow of exhaust gas prior to the exhaust gas passing through the carbon dioxide absorbent material, an exhaust gas outlet port connected to the flow of exhaust gas after the flow of exhaust gas has passed through carbon dioxide absorbent material; and a second capture tank, containing carbon dioxide absorbent material which operates to absorb carbon dioxide from the exhaust gas, the second capture tank comprising:

an exhaust gas inlet port connected to the flow of exhaust gas prior to the exhaust gas passing through the carbon dioxide absorbent material, an exhaust gas outlet port connected to the flow of exhaust gas after the flow of exhaust gas has passed through carbon dioxide absorbent material;

wherein, the heat exchange loop is in heat exchange communication with either the first capture tank or the second capture tank, wherein the heat exchange fluid operates to transfer heat from the exhaust gas or the engine coolant to either the first capture tank or the second capture tank, wherein the heat from the exhaust gas or the engine coolant operates to release a portion of the carbon dioxide absorbed by the carbon dioxide absorbent material in either the first capture tank or the second capture tank.

18. The bottoming cycle power system of claim 17, wherein:

when the exhaust gas inlet port of the first capture tank is connected to receive the flow of exhaust gas prior to the exhaust gas passing through the carbon dioxide absorbent material in the first capture tank, then the exhaust gas outlet port of the first capture tank is connected to output the flow of exhaust gas after the exhaust gas has passed through the carbon dioxide absorbent material in the first capture tank and the heat exchange loop is in heat exchange communication with the second capture tank, wherein the heat exchange fluid operates to transfer heat from the exhaust gas or the engine coolant to the second capture tank, wherein the heat from the exhaust gas or the engine coolant operates to release a portion of the carbon dioxide absorbed by the carbon dioxide absorbent material in the second capture tank; and when the exhaust gas inlet port of the second capture tank is connected to receive the flow of exhaust gas prior to the exhaust gas passing through the carbon dioxide absorbent material in the second capture tank, then the exhaust gas outlet port of the second capture tank is connected to output the flow of exhaust gas after the exhaust gas has passed through the carbon dioxide absorbent material in the second capture tank and the heat exchange loop is in heat exchange communication with the first capture tank, wherein the heat exchange fluid operates to transfer heat from the exhaust gas or the engine coolant to the first capture tank, wherein the heat from the exhaust gas or the engine coolant operates to release a portion of the carbon dioxide absorbed by the carbon dioxide absorbent material in the first capture tank.

19. The carbon dioxide capture system of claim 1, comprising:

a second capture tank containing carbon dioxide absorbent material which operates to absorb carbon dioxide from the flow of exhaust gas from the internal combustion engine;

wherein, the heat exchange fluid operates to transfer heat from the exhaust gas or the engine coolant to the first capture tank while the flow of exhaust gas is passing through the carbon dioxide absorbent material in the second capture tank.

20. A method of removing carbon dioxide from a flow of exhaust gas from an internal combustion engine, the method comprising:

routing the flow of exhaust gas into a first capture tank of a carbon dioxide capture system;

absorbing carbon dioxide in the first capture tank from the exhaust gas with carbon dioxide absorbent material disposed in the first capture tank;

routing the flow of exhaust gas out of the first capture tank;

connecting a heat exchange loop in heat exchange communication with the first capture tank and further in heat exchange communication with one of the flow of exhaust gas or a flow of engine coolant from the internal combustion engine;

circulating a heat exchange fluid through the heat exchange loop;

transferring heat from the exhaust gas or the engine coolant to the first capture tank via the heat exchange fluid while the engine is running; and releasing a portion of the carbon dioxide absorbed by the carbon dioxide absorbent material in the first capture tank, as a result of the heat transferred from the exhaust gas or the engine coolant.

21. The method of claim 20, comprising:

routing the flow of exhaust gas through a first flow path of an exhaust gas to heat exchange fluid heat exchanger;

routing the heat exchange fluid through a second flow path of the exhaust gas to heat exchange fluid heat exchanger;

transferring heat from the exhaust gas to the heat exchange fluid via the exhaust gas to heat exchange fluid heat exchanger;

flowing the heat exchange fluid to the first capture tank; and transferring heat from the heat exchange fluid to the absorbent material in the first capture tank.

22. The method of claim 21, comprising:

routing the flow of exhaust gas through a turbo-expander of a turbine-generator system, then through the first flow path of the exhaust gas to heat exchange fluid heat exchanger, then through a turbo-compressor of the turbine-generator system, then through the first capture tank.

23. The method of claim 20, comprising:

receiving the exhaust gas from the engine into the heat exchange loop, such that the exhaust gas is the heat exchange fluid that flows through the heat exchange loop.

24. The method of claim 20, comprising:

receiving the engine coolant from the engine into the heat exchange loop, such that the engine coolant is the heat exchange fluid that flows through the heat exchange loop.

25. The method of claim 20, comprising:

routing the flow of engine coolant through a first flow path of an engine coolant to heat exchange fluid heat exchanger;

routing the heat exchange fluid through a second flow path of the engine coolant to heat exchange fluid heat exchanger;

transferring heat from the engine coolant to the heat exchange fluid via the engine coolant to heat exchange fluid heat exchanger;

flowing the heat exchange fluid to the first capture tank; and transferring heat from the heat exchange fluid to the absorbent material in the first capture tank.

26. The method of claim 20, comprising:

routing the flow of exhaust gas through a turbo-expander disposed on a turbo-crankshaft of a turbine-generator system:

compressing the flow of exhaust gas via a turbo-compressor disposed on the turbo-crankshaft of the turbine-generator system after the exhaust gas passes through the turbo-expander;

generating electric power via a bottoming cycle generator disposed on the turbo-crankshaft of the turbine-generator system; and providing at least a portion of electric power required to operate the carbon dioxide capture system from the electric power generated by the bottoming cycle generator.

27. The method of claim 20, comprising:

routing the flow of exhaust gas into a second capture tank of the carbon dioxide capture system;

absorbing carbon dioxide in the second capture tank from the exhaust gas with carbon dioxide absorbent material disposed in the second capture tank;

routing the flow of exhaust gas out of the second capture tank;

connecting the heat exchange loop in heat exchange communication with either the first capture tank or the second capture tank and further in heat exchange communication with one of the flow of exhaust gas or a flow of engine coolant from the internal combustion engine;

circulating the heat exchange fluid through the heat exchange loop;

transferring heat from the exhaust gas or the engine coolant to either the first capture tank or the second capture tank via the heat exchange fluid; and releasing a portion of the carbon dioxide absorbed by the carbon dioxide absorbent material in either the first capture tank or the second capture tank, as a result of the heat transferred from the exhaust gas or the engine coolant.

28. The method of claim 27, comprising:

connecting the heat exchange loop in heat exchange communication with the second capture tank and further in heat exchange communication with one of the flow of exhaust gas or a flow of engine coolant when the flow of exhaust gas is routed into the first capture tank; and connecting the heat exchange loop in heat exchange communication with the first capture tank and further in heat exchange communication with one of the flow of exhaust gas or a flow of engine coolant when the flow of exhaust gas is routed into the second capture tank.

29. The method of claim 20, comprising:

routing the flow of exhaust gas into a second capture tank of the carbon dioxide capture system;

absorbing carbon dioxide in the second capture tank from the exhaust gas with carbon dioxide absorbent material disposed in the second capture tank; and transferring heat from the exhaust gas or the engine coolant to the first capture tank via the heat exchange fluid while the flow of exhaust gas is passing through the carbon dioxide absorbent material in the second capture tank.

* * * * *